US009741297B2

(12) United States Patent
Uchiyama

(10) Patent No.: US 9,741,297 B2
(45) Date of Patent: Aug. 22, 2017

(54) IMAGE DISPLAY APPARATUS WITH CONVERSION ANALOG SIGNAL GENERATOR

(71) Applicant: JVC KENWOOD CORPORATION, Yokohama-shi, Kanagawa (JP)

(72) Inventor: Yuji Uchiyama, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 14 days.

(21) Appl. No.: 15/059,724

(22) Filed: Mar. 3, 2016

(65) Prior Publication Data

US 2016/0189643 A1 Jun. 30, 2016

Related U.S. Application Data

(63) Continuation of application No. PCT/JP2014/007072, filed on Aug. 6, 2014.

(30) Foreign Application Priority Data

Sep. 18, 2013 (JP) ..... 2013-193580

(51) Int. Cl.
*G09G 3/36* (2006.01)
*G09G 3/34* (2006.01)

(52) U.S. Cl.
CPC ..... *G09G 3/3607* (2013.01); *G09G 3/3426* (2013.01); *G09G 2300/0828* (2013.01); *G09G 2310/024* (2013.01); *G09G 2310/027* (2013.01); *G09G 2310/0259* (2013.01); *G09G 2320/0271* (2013.01); *G09G 2320/0285* (2013.01)

(58) Field of Classification Search
CPC ..... G09G 3/3685
USPC ..... 345/100
See application file for complete search history.

(56) References Cited

U.S. PATENT DOCUMENTS 6,950,114 B2 * 9/2005 Honda ..... H04N 7/0122 345/626
8,212,764 B2 * 7/2012 Song ..... G09G 3/2092 345/102
2002/0145581 A1 * 10/2002 Kudo ..... G09G 3/3685 345/89

FOREIGN PATENT DOCUMENTS

JP 06-178238 * 6/1994
JP H6-178238 A 6/1994
JP 2011-013517 A 1/2011
(Continued)

OTHER PUBLICATIONS

Official Action issued in corresponding Japanese application No. 2015-537597 dated Dec. 6, 2016.

*Primary Examiner* — Roy Rabindranath
(74) *Attorney, Agent, or Firm* — Nath, Goldberg & Meyer; Jerald L. Meyer

(57) ABSTRACT

An image display apparatus includes a conversion analog signal generator. A histogram value output section outputs histogram value data of image data of pixels of a line. An accumulator accumulates the histogram value data. The cumulative sums represent the number of analog switches turned off among a plurality of analog switches. A ramp signal data generator generates ramp signal data having a non-linear slope variably-controlled in accordance with the cumulative sum so as to reduce voltage fluctuation of the ramp signal due to load variation caused depending on the number of analog switches turned off. A DA converter converts the ramp signal data to an analog ramp signal and supplies the analog ramp signal to the plurality of analog switches.

5 Claims, 14 Drawing Sheets

(56) References Cited

FOREIGN PATENT DOCUMENTS

| | | | |
|---|---|---|---|
| JP | 2011-53644 | A | 3/2011 |
| JP | 2013-525825 | A | 6/2013 |
| WO | 2008/056462 | A1 | 5/2008 |

* cited by examiner

FIG. 6

| GRAY-LEVEL (DATA LEVEL) | HISTOGRAM VALUE | CUMULATIVE SUM |
|---|---|---|
| 0 | 0 | 0 |
| 1 | 0 | 0 |
| 2 | 3 | 3 |
| 3 | 2 | 5 |
| 4 | 0 | 5 |
| 5 | 2 | 7 |
| 6 | 0 | 7 |
| 7 | 1 | 8 |

IMAGE DISPLAY APPARATUS WITH CONVERSION ANALOG SIGNAL GENERATOR

CROSS REFERENCE TO RELATED APPLICATION

This application is a Continuation of PCT Application No. PCT/JP2014/070724 filed on Aug. 6, 2014, and claims the priority of Japanese Patent Application No. 2013-193580 filed on Sep. 18, 2013; the entire contents of both of which are incorporated herein by reference.

BACKGROUND

The present disclosure relates to an image display apparatus which performs image display by driving display elements with analog voltage obtained by digital-analog conversion (hereinafter, referred to as DA conversion) for digital video signal using ramp signal or the like.

Image display apparatuses that have made a considerable progress in recent years are display panel apparatuses using liquid crystals (liquid crystal display apparatuses). The liquid crystal display apparatuses are widely used in view finders and liquid crystal display panels of video cameras, televisions for automobiles, display panels of navigation systems, displays of notebook personal computers, and the like.

The liquid crystal display apparatuses are originally configured to display analog video signal. The driver circuit of a liquid crystal display apparatus with a high resolution and a high image quality is very large in scale and requires a lot of chips. Moreover, the driver circuit needs to be highly accurate. The cost restriction of the display panel is one of major factors to determine the display quality.

In recent years, peripheral circuits are being increasingly digitalized. It is therefore convenient for the entire system that the video signal is inputted to liquid crystal elements in the form of digital data. In order to implement high image quality without increasing the circuit scale for satisfying the cost restriction, an image display apparatus is proposed, which includes a DA converter to convert digital video signal to analog video signal (refer to Japanese Unexamined Patent Application Publication No. 6-178238 (PTL 1)).

In the conventional image display apparatus described in PTL 1, the same number of video switches (analog switches) as the number of pixels per line are turned on simultaneously at the beginning of every horizontal scanning period, and a simple ramp signal with the same period as the horizontal scanning period including all video signal components from black to white is supplied to data lines through the respective analog switches.

A counter counts based on a clock with a predetermined frequency and outputs the counter value sequentially, changing from the minimum to maximum value in each horizontal scanning period.

Comparators compare digital data of the video signal displayed in each horizontal scanning period with the counter value of the counter on a pixel-by-pixel basis, and output a matching pulse when the digital data matches the counter value. The analog switches provided, corresponding to the comparators remain turned off after the matching pulse is outputted.

The level of the ramp signal, just before each analog switch is turned off, is sampled and held to be supplied to the corresponding pixel. The digital video signal is thereby converted to the analog video signal.

The liquid crystal display apparatus described in PTL 1 is configured to sample and hold predetermined voltages corresponding to digital data based on the referential ramp signal.

The liquid crystal display apparatus described in PTL 1 has an advantage of implementing high image quality without increasing in circuit scale.

However, in some pictures to be displayed, the same voltage is sampled and held at the same time for plural pixels, or some voltages are not sampled and held at all. The load on the ramp signal therefore significantly changes in many cases. Such changing load causes tonality degradation called streaking in the displayed image.

FIGS. 15A and 15B illustrate examples of an original image and a displayed image with the tonality degraded. The original image illustrated in FIG. 15A includes a 50% gray box (image 2*a*) and a horizontally-long box (image 3*a*) having the same gray level as the image 2*a*, which are arranged on image 1*a* as a black background. In FIG. 15A, the 50% gray images 2*a* and 3*a* are illustrated in white.

When digital data of the original image is inputted to the liquid crystal display apparatus, the liquid crystal display apparatus displays the image illustrated in FIG. 15B. In the display image illustrated in FIG. 15B, a gray box (image 2*b*) and a horizontally-long box (image 3*b*) which is slightly darker than the image 2*b*—although the image 3*b* originally must have the same gray level as the image 2*b*—are provided on image 1*b* as a black background.

The liquid crystal display apparatus displays the display image as illustrated in FIG. 15B because the horizontal width of the gray part in image 3*b* is larger than that in image 2*b* and the number of analog switches which are turned off at the same time in each horizontal scanning period is smaller in displaying image 3*b* than in displaying image 2*b*.

The cause thereof is described using FIGS. 16 and 17. FIG. 16 illustrates an equivalent circuit diagram of an example of the main part of the liquid crystal display apparatus described in PTL 1. In FIG. 16, an output equivalent circuit 161 of a conversion analog signal generator includes an internal buffer of a DA converter which converts ramp signal data (digital data) to ramp signal (analog signal) and an output impedance $Z_0$ thereof. On the output side of the conversion analog signal generator, n analog switches are connected in parallel.

Herein, the n analog switches correspond to the number of pixels arranged in the horizontal direction of the screen and are turned on at the beginning of every horizontal scanning period.

Pixel values of the digital video signal are compared with respective counter values of n counters (not illustrated) which count up from the minimum to the maximum value in each horizontal scanning period. Each counter is configured to output a matching pulse when the pixel value matches the counter value. By the matching pulse, the analog switch at the position of the pixel corresponding to the counter whose counter value matches the pixel value is turned off until the beginning of the next horizontal scanning period.

When turned off, the analog switch samples the ramp signal, which starts from the minimum gray level at the beginning of each horizontal scanning period and reaches the maximum gray level just before the end of the horizontal scanning period, and outputs the sampled ramp signal voltage to the corresponding pixel circuit.

In FIG. 16, the equivalent circuit 162 of each analog switch is represented by a series circuit of one analog switch and input impedance $Z_1$. $V_0$ indicates output voltage of the buffer in the DA converter which generates the ramp signal (analog signal) from the ramp signal data (digital data), and $V_1$ indicates input voltage of the analog ramp signal which is outputted from the DA converter and is supplied to the n analog switches in common.

Herein, the input voltage $V_1(s)$ of the analog switches is expressed by Equation (1) below. In Equation (1), s is the number of analog switches which are simultaneously turned off at a certain time, and 0<=s<=n.

$$V_1(s)=[Z_1/\{(n-s)Z_0+Z_1\}]V_0 \quad (1)$$

In the black background (image 1*b*) illustrated in FIG. 15B, $V_0$=0, and the input voltage $V_1$ of the analog switches is 0 based on Equation (1).

Herein, it is assumed that $Z_0$=1, $Z_1$=100, and n=256. The horizontal width of the 50% gray image 2*b* illustrated in FIG. 15 is 64 pixels, and the horizontal width of the 50% gray image 3*b* illustrated is 128 pixels. In this case, in displaying image 2*b*, the number s of analog switches simultaneously turned off is 192 (=256−64). In displaying image 3*b*, the number s of analog switches simultaneously turned off is 128 (=256−128).

The number s of analog switches turned off is also referred to as the number of off analog switches.

It is assumed that the original buffer output voltage $V_0$ is 0.5 in displaying a 50% gray image.

Based on Equation (1), the input voltage $V_1$(192) of the analog switches in displaying image 2*b* is 0.305, and the input voltage $V_1$(128) of the analog switches in displaying image 3*b* is 0.219.

The images 2*b* and 3*b*, which originally must be displayed with an identical gray level, are different in horizontal width and are therefore different in number s of analog switches simultaneously turned off. This results in the difference in gray level as described above.

Moreover, in the processes of displaying images 2*b* and 3*b*, the input voltage $V_1$ must be 0.5 (50%) but is lower than 0.5. Accordingly, images 2*b* and 3*b* have lower gray levels.

It is therefore revealed that the changes in buffer load, depending on the number s of off analog switches in each line display period (each horizontal scanning period) causes tonality degradation.

FIG. 17 is a graph illustrating changes of the input voltage $V_1(s)$ with respect to the number s of off analog switches. In the graph illustrated in FIG. 17, $V_0$=0.5, $Z_0$=1, and $Z_1$=100. This graph reveals that as the number s of off analog switches increases, the input voltage $V_1(s)$ of the analog switches approaches the value indicating the original gray level to be displayed.

In order to solve the aforementioned problem, an image display apparatus described in Japanese Unexamined Patent Application Publication No. 2011-53644 (PTL 2) is configured as follows. The image display apparatus described in PTL 2 includes the same number of dummy pixels as the number of pixels in a row of the pixel section. To a signal line connected to the dummy pixels, current to charge the parasitic capacitance of the signal line due to ramp signal supplied through a ramp signal line is flown.

The image display apparatus described in PTL 2 includes at least one current detector to detect the charging current, a wire having an end connected to the point of connection between each of plural analog switches (video switches), and a ramp signal line. In the image display apparatus, plural dummy loads are provided for the respective wires, and the charging current detected by the current detectors is applied to the dummy loads.

In the image display apparatus described in PTL 2, current having the same value as the charging current flowing through the data lines connected to the analog switches turned off is flown to the dummy loads corresponding to the analog switches turned off, so that changes in current in the ramp signal line can be compensated accurately. In the image display apparatus described in PTL 2, therefore, changes in voltage in the ramp signal line can be reduced accurately.

SUMMARY

However, in the liquid crystal display apparatus of PTL 2, it is necessary to provide the dummy pixels for the liquid crystal display elements. When the dummy pixels are provided, the increase in scale of the internal circuit section of each liquid crystal display element prevents high-density arrangement of pixels. Moreover, the increase in circuit scale reduces the yield and increases the cost.

In addition, the dummy pixels cannot reduce tonality degradation precisely because of variation in the dummy pixels in some cases. Once the liquid crystal display elements are designed, the variation in dummy pixels cannot be controlled. The liquid crystal display apparatus therefore cannot display a high quality image excellent in tonality.

An aspect of the embodiments provides an image display apparatus, including: a pixel section including a plurality of pixels arranged at intersections of a plurality of data lines and a plurality of gate lines; a vertical direction driver configured to sequentially supply a pixel selection signal to the plurality of gate lines and sequentially select each pixel of the pixel section on the basis of pixels of each line; a plurality of analog switches connected to the plurality of data lines one to one; a holding section configured to hold image data of pixels of a line of a display digital video signal; a conversion analog signal generator configured to generate a ramp signal composed of a sawtooth wave, to commonly supply the generated ramp signal to the plurality of analog switches, and to supply image data of the pixels of the line to the holding section in synchronization with the ramp signal, the ramp signal changing in level with time at such a slope that the level of the ramp signal starts with one of black and white levels at the beginning of each horizontal scanning period and reaches the other level right before the end of the horizontal scanning period and the slope is variably-controlled in accordance with the number of analog switches turned off among the plurality of analog switches to be non-linear; and a controller configured to simultaneously turn the plurality of analog switches on at the beginning of each horizontal scanning period to supply the ramp signal to the plurality of data lines through the plurality of analog switches, to compare on a pixel-by-pixel basis, the image data of the pixels of the line held by the holding section with a first counter value sequentially changing from one of minimum and maximum gray levels to the other in each horizontal scanning period, to turn off only the analog switches provided corresponding to the pixels having pixel data matching the first counter value until the beginning of the next horizontal scanning period, and through the data lines connected to the analog switches turned off, to cause the pixels to sample and hold the potential of the ramp signal just before the analog switches are turned off.

The conversion analog signal generator includes: a histogram value output section configured to detect histogram values of respective gray levels included by image data of the pixels of the line and outputs histogram value data at each horizontal scanning period; an accumulator configured to accumulate the histogram value data to calculate a cumulative sum representing the number of analog switches turned off among the plurality of analog switches; a ramp signal data generator configured to generate ramp signal data having a non-linear slope variably-controlled in accordance with the cumulative sum so as to reduce voltage fluctuation of the ramp signal due to load variation caused and depending on the number of analog switches turned off; a DA converter configured to convert the ramp signal data to the ramp signal as an analog signal and supply the ramp signal to the plurality of analog switches; and a delay section configured to delay the image data of the pixels of the one line and supply the delayed image data to the holding section in synchronization with the ramp signal outputted from the DA converter.

BRIEF DESCRIPTION OF THE DRAWINGS

FIG. 6 is a table illustrating gray levels, histogram values, and cumulative sums for an image data input period for odd-numbered lines.

DETAILED DESCRIPTION

Figure 1A:
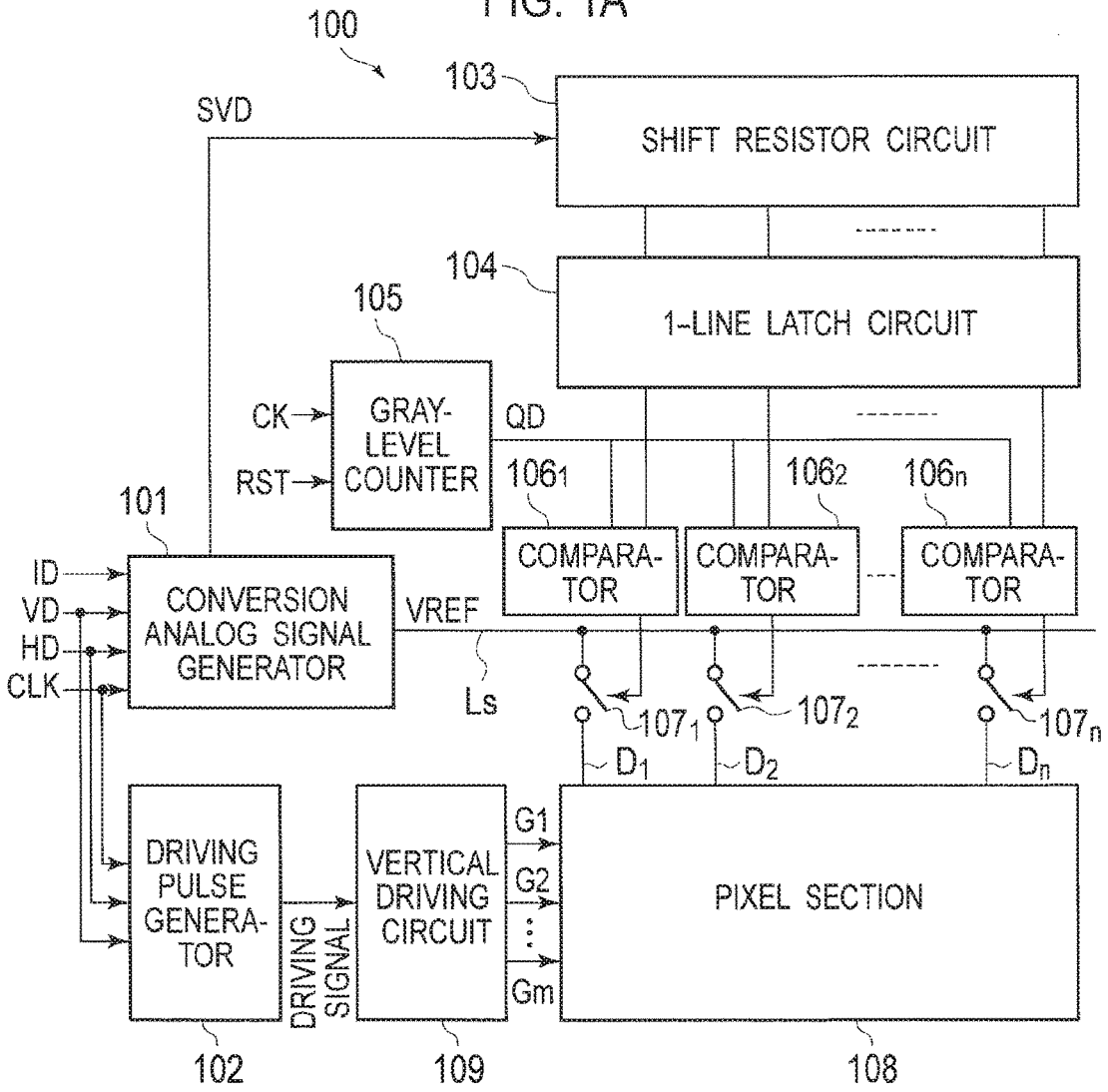
FIG. 1A is a block diagram illustrating an image display apparatus according to at least one embodiment.
Figure 1B:
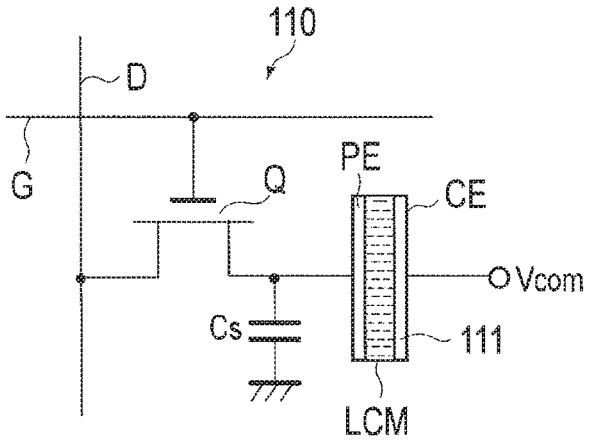
FIG. 1B is a configuration diagram of an example of a pixel.

A description is given of an embodiment with reference to the drawings. FIG. 1A is a block diagram illustrating an image display apparatus according to the embodiment, and FIG. 1B is a configuration diagram illustrating an example of a pixel.

An image display apparatus 100 according to the embodiment is a liquid crystal display apparatus used in a reflective liquid crystal projector or the like.

The image display apparatus 100 includes a conversion analog signal generator 101, a driving pulse generator 102, a shift resistor circuit 103, a one-line latch circuit 104, a gray-level counter 105, comparators $\mathbf{106}_1$ to $\mathbf{106}_n$, analog switches $\mathbf{107}_1$ to $\mathbf{107}_n$, a pixel section 108, and a vertical driving circuit 109.

The conversion analog signal generator 101 receives a digital video signal ID to be displayed, a vertical synchronization signal VD, a horizontal synchronization signal HD, and a clock CLK.

The conversion analog signal generator 101 performs predetermined processing described below to generate a display digital video signal SVD and a ramp signal VREF which are in synchronization.

The display digital video signal SVD is supplied to the shift resistor circuit 103, and the ramp signal VREF is supplied through a ramp signal line Ls to input terminals of the analog switches $\mathbf{107}_1$ to $\mathbf{107}_n$.

The ramp signal VREF is a sawtooth wave which gradually changes in level in the same period as one horizontal scanning period so as to start with one of either black or white levels and reach the other level just before the end of the horizontal scanning period.

The driving pulse generator 102 receives the vertical synchronization signal VD, horizontal synchronization signal HD, and clock CLK. The driving pulse generator 102 generates a driving signal synchronized with the display digital video signal SVD and ramp signal VREF and supplies the generated driving signal to the vertical driving circuit 109.

The shift resistor circuit 103 sequentially shifts the supplied display digital video signal SVD on a pixel-by-pixel basis. The one-line latch circuit 104 temporarily holds the digital video signal (hereinafter, also referred to as pixel data) outputted in parallel from the shift resistor circuit 103, on a line-by-line basis.

The shift resistor circuit 103 and one-line latch circuit 104 constitute a holding section to hold image data of pixels of a line in the display digital video signal SVD.

The gray-level counter 105 counts pulses of the clock CK with a predetermined frequency synchronized with the synchronization signal of the digital video signal ID and outputs counter value QD (referential gray-level data) which changes from the minimum to the maximum gray-level to be displayed and comes to the same value again in a one-line period.

The n comparators 106$_1$ to 106$_n$ are provided corresponding to the n pixels arrayed in the horizontal direction of the pixel section 108. The n comparators 106$_1$ to 106$_n$ compare the counter value QD of the gray-level counter 105 with respective n pieces of pixel data of each line from the one-line latch circuit 104 and output a matching pulse when the counter value QD matches the pixel data.

The analog switches 107$_1$ to 107$_n$ are provided corresponding to the comparators 106$_1$ to 106$_n$ and n pixels arrayed in the horizontal direction of the pixel section 108, respectively. At every horizontal scanning period, the analog switches 107$_1$ to 107$_n$ are controlled and turned on simultaneously at the beginning of the horizontal scanning period, and each analog switch 107$_1$ to 107$_n$ supplies the ramp signal VREF through corresponding data line $D_1$ to $D_n$ to m pixels arrayed in the vertical direction in the pixel section 108.

The pixel section 108 is composed of pixels arrayed in a two-dimensional matrix (n pixels in the horizontal direction of the screen by m pixels in the vertical direction: m rows by n columns).

In the pixel section 108, m pixels of each column (in the vertical direction) are connected to one of the n data lines $D_1$ to $D_n$, and n pixels arrayed in each row (in the horizontal direction) are coupled to one of the m gate lines $G_1$ to $G_m$.

That is, the pixel section 108 is composed of n×m pixels provided at intersections of the n data lines $D_1$ to $D_n$ and the m gate lines $G_1$ to $G_m$.

Each pixel can be a pixel 110 configured as illustrated in FIG. 1B, for example. In FIG. 1B, the pixel 110 includes a pixel selection transistor Q, a signal holding capacitance Cs, and a liquid crystal element 111, which are provided at the intersection of a data line D and a gate line G.

The data line D is any one of the data lines $D_1$ to $D_n$ of FIG. 1A, and the gate line G is any one of the gate lines $G_1$ to $G_n$.

In the pixel selection transistor Q, the gate is connected to the gate line G, the drain is connected to the data line D, and the source is connected to an ungrounded terminal of the signal holding capacitance Cs and a pixel driving electrode PE of the liquid crystal element 111.

The pixel 110 is selected when the pixel selection transistor Q is turned on by a pixel selection signal (a gate signal) inputted through the gate line G. The pixel 110 receives the ramp signal through the data line D connected to the corresponding one of the analog switches 107$_1$ to 107$_n$.

The pixel 110 is configured so that the ramp signal (or a DA-converted analog video signal) sampled when the analog switch is turned off is written and held in the signal holding capacitance Cs through the pixel selection transistor Q and is then applied to the pixel driving electrode PE of the liquid crystal element 111.

The liquid crystal element 111 as an example of the display elements has a structure in which a liquid crystal layer LCM is sandwiched between the pixel driving electrode PE and a common electrode (a transparent electrode) CE facing each other. To the common electrode CE, common voltage Vcom is applied.

The pixel driving electrode PE is driven with voltage corresponding to analog video signal voltage (the sampled ramp signal voltage herein) to control the light transmittance of the liquid crystal layer LCM. The liquid crystal element 111 thus displays video.

The vertical driving circuit 109 constitutes a vertical direction driver and receives the driving signal. The vertical driving circuit 109 supplies the pixel selection signal sequentially to the m gate lines, one gate line (G1 to Gm) per horizontal scanning period (1H), which is synchronized with the horizontal synchronization signal HD, to repeatedly select n pixels arrayed in the same row of the pixel section 108 at the same time. The vertical driving circuit 109 thereby selects all the pixels in one frame period.

Figure 2:
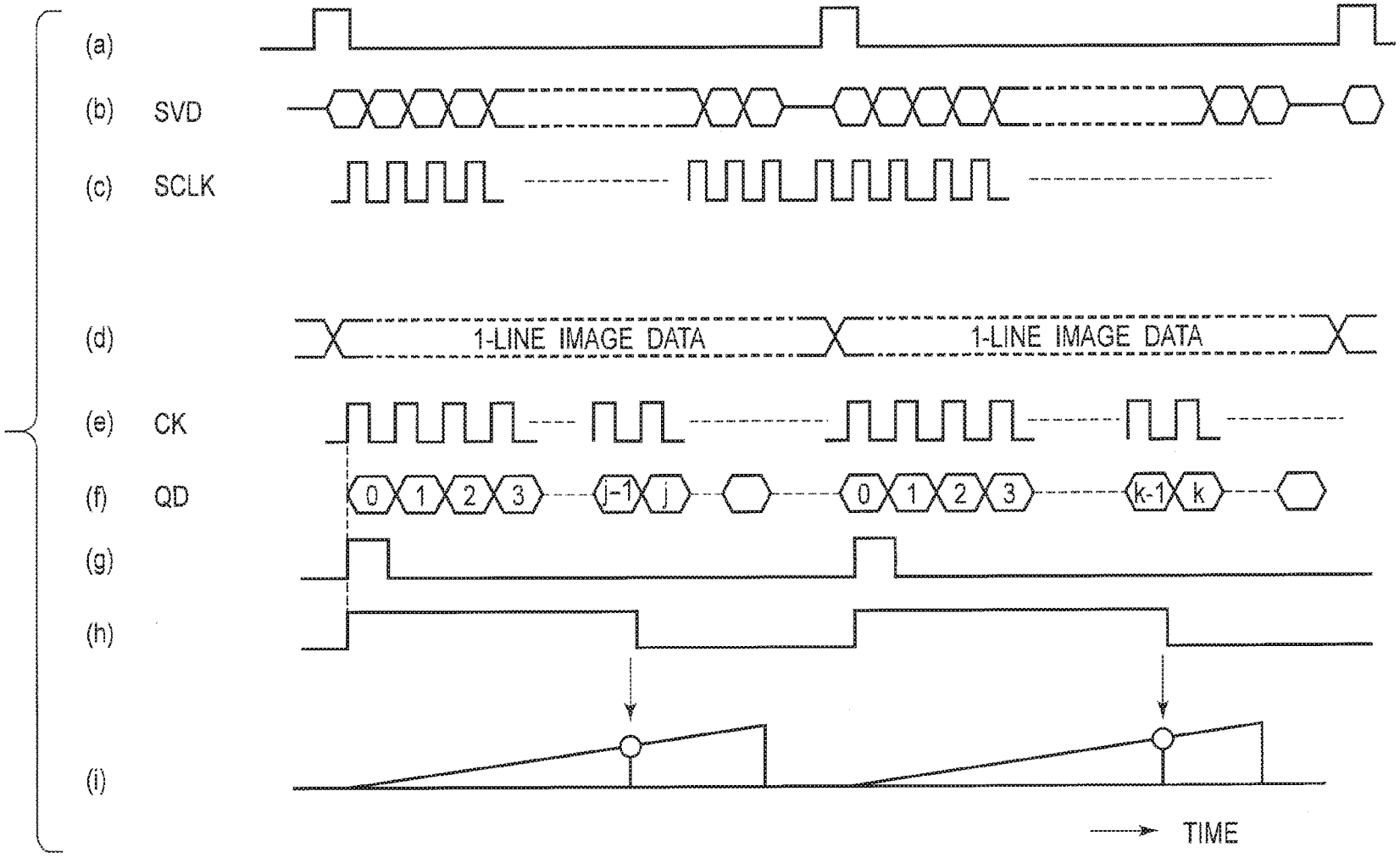
FIG. 2 is a timing diagram for explaining a schematic operation of the image display apparatus according to the embodiment.

Next, a description is given of the schematic operation of the image display apparatus 100 illustrated in FIG. 1A with reference to the timing diagram of FIG. 2.

The conversion analog signal generator 101 generates the display digital video signal SVD illustrated in (b) of FIG. 2 and ramp signal VREF illustrated in (i) of FIG. 2. The display digital video signal SVD includes pixel data composed of plural bits synthesized in chronological order and is synchronized with the horizontal synchronization signal HD illustrated in (a) of FIG. 2. The ramp signal VREF has the same period as the horizontal scanning period.

The shift resistor circuit 103 sequentially shifts and loads the inputted display digital video signal SVD line by line based on shift clock SCLK illustrated in (c) of FIG. 2.

When the shift resistor circuit 103 finishes loading part of the display digital video signal SVD corresponding to a line, the one-line latch circuit 104 temporarily holds n pieces of pixel data of the line which are outputted from the shift resistor circuit 103 in parallel as schematically illustrated in (d) of FIG. 2. After holding the pixel data, the one-line latch circuit 104 supplies the same to the first data input terminals of the comparators 106$_1$ to 106$_n$.

The gray level counter 105 counts the pulses of the clock CK illustrated in (e) of FIG. 2 and outputs the counter value QD in synchronization with each horizontal scanning period. The counter value QD represents plural gray levels sequentially varied from the minimum to the maximum value as illustrated in (f) of FIG. 2. The gray level counter 105 commonly supplies the counter value QD to second data input terminals of the comparators 106$_1$ to 106$_n$.

The comparators 106$_1$ to 106$_n$ independently compare the pixel data supplied to the first data input terminals on a pixel-by-pixel basis with the counter value QD commonly supplied to the second data input terminals. When the pixel data matches the counter value QD, the comparator 106$_1$ to 106$_n$ outputs a matching pulse.

The comparator 106$_1$ to 106$_n$ supplies a matching pulse to the corresponding one of the analog switches 107$_1$ to 107$_n$ to turn off the same.

The gray level counter 105 and comparators 106$_1$ to 106$_n$ constitute an analog switch controller.

The analog switches 107$_1$ to 107$_n$ receive switch start pulses illustrated in (g) of FIG. 2 and are turned on simultaneously at the beginning of every horizontal scanning period.

The switch start pulses, clock CK, shift clock SCLK, ramp signal VREF are all synchronized with the horizontal synchronization signal HD.

Some of the analog switches 107$_1$ to 107$_n$ are then turned off upon the matching pulses outputted from the comparators 106$_1$ to 106$_n$ provided corresponding thereto.

(h) of FIG. 2 illustrates timings when a certain one of the analog switches 107$_1$ to 107$_n$ is opened and closed. The high level thereof schematically represents on periods while the low level schematically represents off periods.

(h) of FIG. 2 illustrates that the analog switch receives a matching pulse and is turned off upon a change from the high level to the low level.

As for the analog switch with the opening and closing timings illustrated in (h) of FIG. 2, the analog switch is turned off when the gray level of a pixel which is at a certain line in the pixel column corresponding to the analog switch of interest is equal to a counter value QD of j and is turned off at the next line when the gray level of the pixel is equal to a counter value QD of k.

The potentials of the data lines connected to the analog switches $\mathbf{107}_1$ to $\mathbf{107}_n$ gradually increase with the inputted ramp signal VREF while the analog switches $\mathbf{107}_1$ to $\mathbf{107}_n$ are on.

Once each analog switch is turned off, the analog switch remains turned off until the beginning of the next horizontal scanning period. Accordingly, the potential of the ramp signal VREF (indicated by white circles in (i) of FIG. 2) just before the analog switch is turned off is sampled and held in the corresponding data line.

The sampled and held potential is held by the signal holding capacitance Cs of a pixel which is selected by the gate lines $G_1$ to $G_m$ among the m pixels arrayed in the vertical direction in the pixel section 108 and connected via the data line of interest.

The voltage of the ramp signal VREF held at this time corresponds to the pixel value (the gray level) of the pixel of interest in the digital video signal. That is, the pixel data of the inputted display digital video signal SVD is converted to the analog video signal, which is then stored in the signal holding capacitance Cs of the pixel of interest.

As described above, in each pixel, the voltage of the ramp signal VREF just before the corresponding one of the analog switches $\mathbf{107}_1$ to $\mathbf{107}_n$ is turned off, is held by the signal holding capacitance Cs of the pixel until the next frame to drive the liquid crystal element of the pixel.

In the image display apparatus 100, the time when the analog switches $\mathbf{107}_1$ to $\mathbf{107}_n$ are turned off, that is, the time when the voltage of the ramp signal is sampled and held, depends on the picture design of the video signal to be displayed. The analog switches $\mathbf{107}_1$ and $\mathbf{107}_n$ are all turned off at the same time in some cases, or are turned off at different times in other cases.

The order that the analog switches $\mathbf{107}_1$ to $\mathbf{107}_n$ are turned off is also not fixed. When the level of the inputted ramp signal VREF gradually changes from the black level (corresponding to 0% light transmittance of the liquid crystal layer) to the white level (corresponding to 100% light transmittance of the liquid crystal layer), the analog switches are turned off in ascending order of gray levels to be displayed by the pixels connected to the respective analog switches. The order of turning off the analog switches depends on each picture.

The image display apparatus 100 has features including good linearity due to the operation of the DA conversion using the ramp signal. The image display apparatus 100 includes the conversion analog signal generator 101 in order to reduce tonality degradation (waveform interference) due to voltage fluctuation of the ramp signal, which is caused by a load variation of the ramp signal data generator that dynamically changes on the basis of lines in the digital video signal for the display.

Next, a description is given of the configuration and operation of the conversion analog signal generator 101 in detail.

Figure 3:
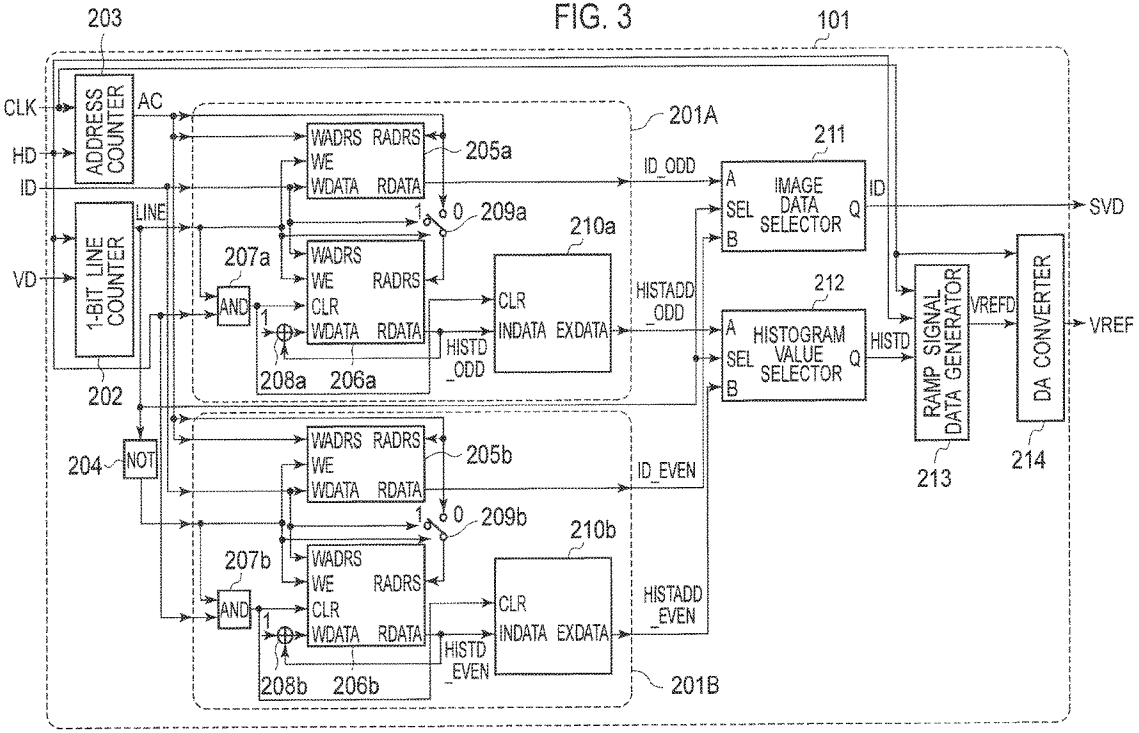
FIG. 3 is a block diagram illustrating a concrete configuration example of a conversion analog signal generator illustrated in FIG. 1A.
Figure 4:
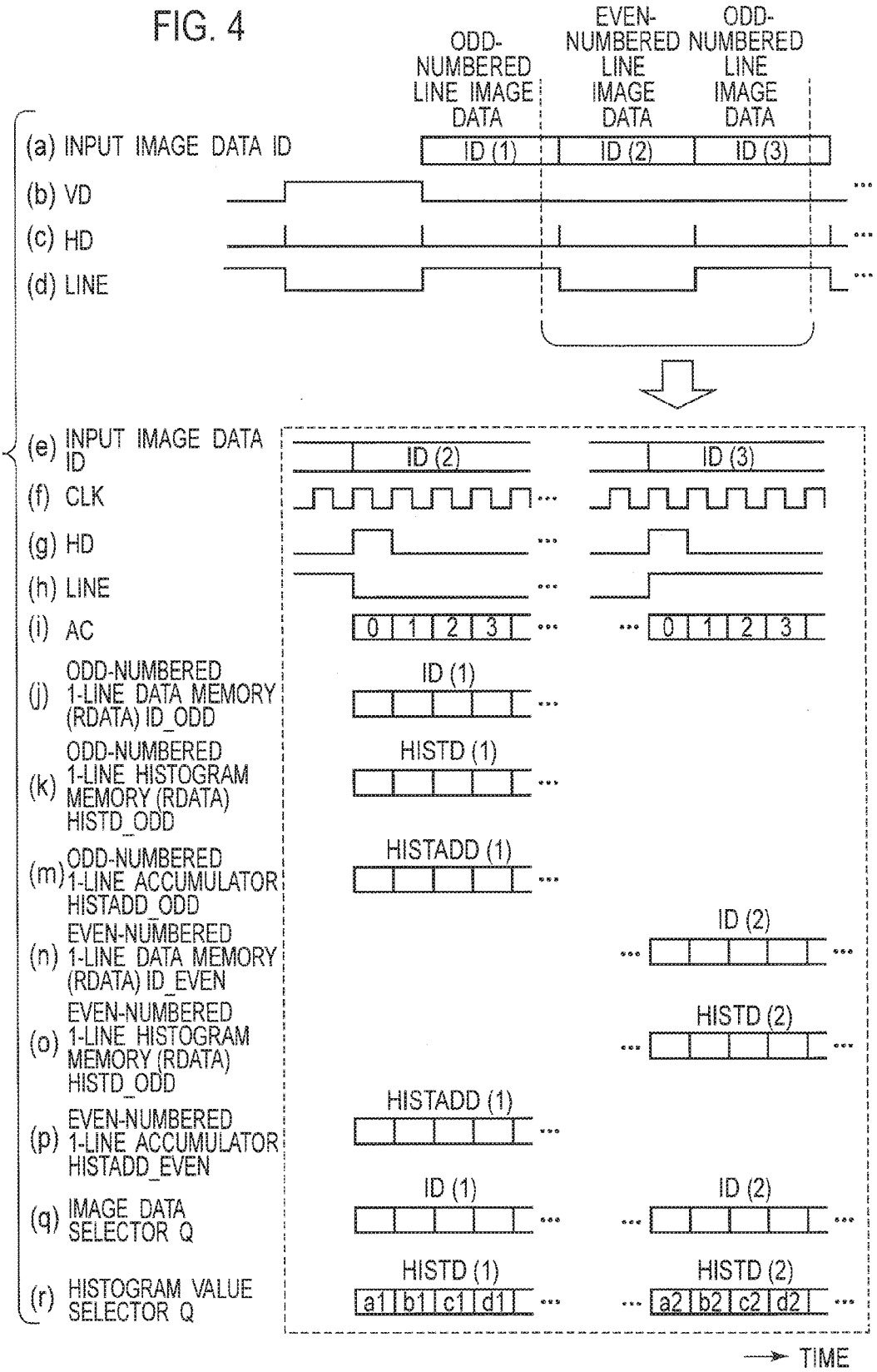
FIG. 4 is a timing diagram for explaining a schematic operation of the conversion analog signal generator illustrated in FIG. 3.

FIG. 3 is a block diagram illustrating a specific configuration example of the conversion analog signal generator 101, and FIG. 4 is a timing diagram for explaining the schematic operation of the conversion analog signal generator 101 illustrated in FIG. 3. For convenience, the time axis of (a) to (d) of FIG. 4 is different from that of (e) to (r).

As illustrated in FIG. 3, the conversion analog signal generator 101 receives the digital video signal ID to be displayed, the vertical synchronization signal VD, the horizontal synchronization signal HD, and the clock CLK.

The conversion analog signal generator 101 includes an odd-numbered line ramp signal data generator 201A, an even-numbered line ramp signal data generator 201B, a one-bit line counter 202, an address counter 203, a NOT circuit 204, an image data selector 211, a histogram value selector 212, a ramp signal data generator 213, and a DA converter 214.

The conversion analog signal generator 101 generates and outputs the display digital video signal SVD and ramp signal VREF.

The odd-numbered line ramp signal data generator 201A includes an odd-numbered one-line data memory 205*a* (hereinafter, referred to as a data memory 205*a*), an odd-numbered line histogram memory 206*a* (hereinafter, referred to as a histogram memory 206*a*), an AND circuit 207*a*, an adder 208*a*, a switch 209*a*, and an odd-numbered line accumulator 210*a*.

The histogram memory 206*a* is a histogram value output section configured to detect histogram values of respective gray levels of the image data of pixels in each odd-numbered line every horizontal scanning period and outputs histogram value data.

The even-numbered line ramp signal data generator 201B has the same configuration as that of the odd-numbered line ramp signal data generator 201A.

The even-numbered line ramp signal data generator 201B includes an even-numbered one-line data memory 205*b* (hereinafter, referred to as a data memory 205*b*), an even-numbered line histogram memory 206*b* (hereinafter, referred to as a histogram memory 206*b*), an AND circuit 207*b*, an adder 208*b*, a switch 209*b*, and an even-numbered line accumulator 210*b*.

The histogram memory 206*b* is a histogram value output section configured to detect histogram values of respective gray levels of the image data of pixels in each even-numbered line every horizontal scanning period and outputs histogram value data.

The data memories 205*a* and 205*b* and histogram memories 206*a* and 206*b* are dual port memories which independently enable reading and writing.

The processing is separately performed for odd-numbered lines and even-numbered lines because a one line period is required to generate a histogram. The histogram is not fixed during this period.

Specifically, while the histogram values are generated in one of the odd-numbered and even-numbered line processes, the histogram values are read in another process. These processes are alternated line by line.

The data memories 205*a* and 205*b* are used to accommodate the time delay corresponding to one line which is produced at the histogram generation.

The one-bit line counter 202 is supplied with the vertical synchronization signal VD illustrated in (b) of FIG. 4 and the horizontal synchronization signal HD illustrated in (c) and (g) of FIG. 4. The one-bit line counter 202 generates a determination signal LINE indicating whether the image data ID of the input digital video signal illustrated in (a) and (e) of FIG. 4 is odd-numbered line image data ID(1), ID(3), . . . or even-numbered line image data ID(2), ID(4), . . . .

As illustrated in (d) and (h) of FIG. 4, the determination signal LINE is 1 when the image data is image data for odd-numbered lines, and is 0 when the image data is image data for even-numbered lines.

The one-bit line counter 202 supplies the determination signal LINE as a write enable signal to write enable terminals WE of the data memory 205*a* and histogram memory 206*a*.

The NOT circuit 204 reverses the polarity of the determination signal LINE, and supplies the obtained signal as a write enable signal to the write enable terminals WE of the data memory 205*b* and histogram memory 206*b*.

The AND circuit 207*a* supplies the AND of the determination signal LINE and the horizontal synchronization signal HD to clear terminals CLR of the histogram memory 206*a* and the odd-numbered line accumulator 210*a* as a clear signal.

The AND circuit 207*b* supplies the AND of the horizontal synchronization signal HD and the signal obtained by reversing the polarity of the determination signal LINE through the NOT circuit 204 to clear terminals CLR of the histogram memory 206*b* and the even-numbered line accumulator 210*b* as a clear signal.

The address counter 203 generates a counter value AC (schematically illustrated in (i) of FIG. 4) synchronized with the image data ID, from the horizontal synchronization signal HD and clock CLK illustrated in (f) of FIG. 4.

The address counter 203 supplies the generated counter value AC to write address terminals WADRS and read address terminals RADRS of the data memories 205*a* and 205*b*.

When the write enable signal is 1, the image data ID inputted to terminals WDATA is written in the data memories 205*a* and 205*b*. When the write enable signal is 0, the data memories 205*a* and 205*b* output the written image data ID from terminals RDATA.

The write enable signals supplied to the data memories 205*a* and 205*b* have polarities opposite to each other as described above and are set to 1 and 0 for odd-numbered and even-numbered lines, respectively.

The image data of a certain odd-numbered line is written in the data memory 205*a* and is then outputted from the data memory 205*a* during the input period of the next even-numbered line as schematically illustrated in (j) of FIG. 4.

The image data of a certain even-numbered line is written in the data memory 205*b* and is then outputted from the data memory 205*b* during the next period to input an odd-numbered line as schematically illustrated in (n) of FIG. 4.

When the determination signal LINE supplied to a select terminal SEL is 0, the image data selector 211 selects and outputs odd-numbered line image data ID_ODD which is read from the data memory 205*a* and supplied to a terminal A.

When the determination signal LINE is 1, the image data selector 211 selects and outputs even-numbered line image data ID_EVEN which is outputted from the data memory 205*b* and supplied to a terminal B.

The image data selector 211 thereby selects image data of an even-numbered line during each odd-numbered line input period of the input image data ID and selects image data of an odd-numbered line during each even-numbered line input period as schematically illustrated in (q).

The image data selector 211 supplies the selected image data to the shift resistor circuit 103 (FIG. 1A) as the display digital video signal SVD.

The data memories 205*a* and 205*b* and image data selector 211 constitute a one-line delay circuit (a delay section) and has a function of selectively outputting one of odd-numbered and even-numbered lines.

In synchronization with the ramp signal VREF outputted from the DA converter 214, the delay section composed of the data memories 205*a* and 205*b* and image data selector 211 delays image data of pixels of each line and supplies the same to the holding section composed of the shift resistor circuit 103 and one-line latch circuit 104.

In the histogram memory 206*a*, the histogram for a certain line is written during the period when the image data of an odd-numbered line is written in the data memory 205*a*. In the histogram memory 206*b*, the histogram for a certain line is written during the period when the image data of an even-numbered line is written in the data memory 205*b*.

The adders 208*a* and 208*b* add 1 to read data outputted from terminals RDATA of the histogram memories 206*a* and 206*b* and supplies the results to terminals WDATA of the same, respectively.

Specifically, the histogram memories 206*a* and 206*b* generate histogram values in the following manner: the input image data ID is supplied to the write address terminals WADRS; and the values obtained by adding 1 to the read data from the histogram memories 206*a* and 206*b* through the adders 208*a* and 208*b* are written in the histogram memories 206*a* and 206*b*.

The read data from the histogram memories 206*a* and 206*b* are values stored at addresses corresponding to the gray levels of pixels in the input image data ID which are supplied to the write address terminals WADRS.

Before histogram values for a certain line are written in the histogram memories 206*a* and 206*b*, all of the histogram values of another line previously stored in the histogram memories 206*a* and 206*b* are cleared by clear signals.

The read address terminals RADRS of the histogram memories 206*a* and 206*b* are supplied with read address signals having opposite truth values through switches 209*a* and 209*b*, and reading operation for the histogram memories 206*a* and 206*b* is performed for each line which is not subjected to writing operation.

The odd-numbered line accumulator 210*a* accumulates plural histogram values HISTD_ODD of each odd-numbered line as schematically illustrated in (k) of FIG. 4. The histogram values HISTD_ODD are sequentially read from the terminal RDATA of the histogram memory 206*a* in the same period (1H) as each horizontal scanning period after the odd-numbered line accumulator 210*a* is cleared by a signal with the period 1H from the AND circuit 207*a*.

The odd-numbered line accumulator 210*a* outputs a calculated cumulative sum HISTADD_ODD as schematically illustrated in (m) of FIG. 4.

The even-numbered line accumulator 210*b* accumulates plural histogram values HISTD_EVEN of each even-numbered line as schematically illustrated in (o) of FIG. 4. The histogram values HISTD_EVEN are sequentially read from the terminal RDATA of the histogram memory 206*b* in the period 1H after the even-numbered line accumulator 210*b* is cleared by the signal of the period 1H from the AND circuit 207*b*.

The even-numbered accumulator 210*b* outputs a calculated cumulative value HISTADD_EVEN as schematically illustrated in (p) of FIG. 4.

When the determination signal LINE supplied to a select terminal SEL of the histogram value selector 212 is 0, the histogram value selector 212 selects and outputs the cumulative value HISTADD_ODD for each odd-numbered line which is read from the odd-numbered line accumulator 210*a* and is supplied to a terminal A (illustrated (m) of FIG. 4).

When the determination signal LINE is 1, the histogram value selector 212 selects and outputs the cumulative value HISTADD_EVEN for even-numbered lines which is read from the even-numbered line accumulator 210*b* and is supplied to a terminal B (illustrated (p) of FIG. 4).

The histogram value selector 212 outputs histogram value data HISTD that represents histogram values for the same line as the line the image data of which is outputted from the image data selector 211 as schematically illustrated in (r) of FIG. 4.

In (r) of FIG. 4, a1, b1, c1, d1, . . . illustrated in HISTD(1) are occurrence frequencies (histogram values) of respective gray levels in odd-numbered line image data ID(1). a2, b2, c2, d2, . . . illustrated in HISTD(2) are occurrence frequencies (histogram values) of respective gray levels in even-numbered line image data ID(2).

Figure 5:
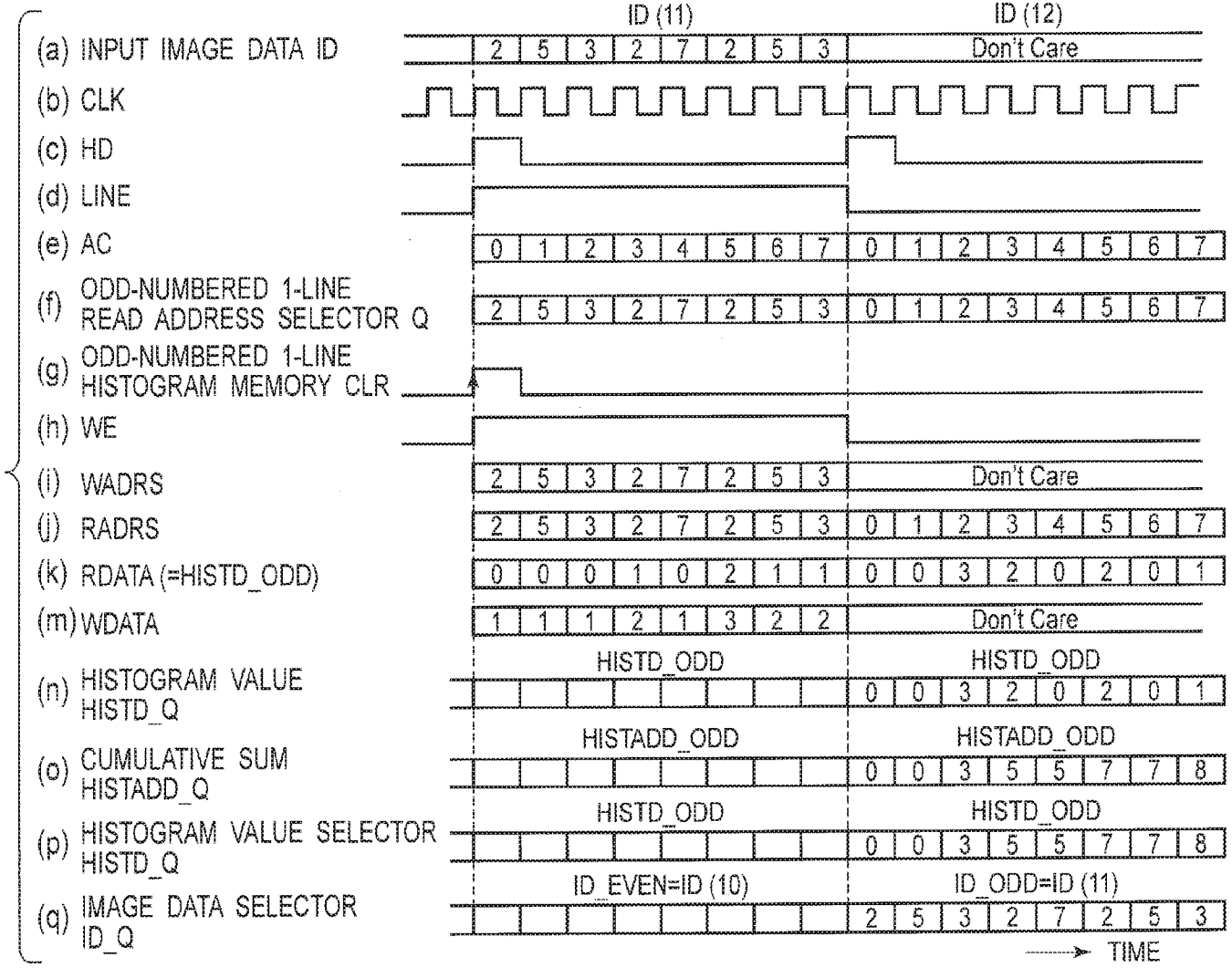
FIG. 5 is a timing diagram for explaining operations of a histogram memory and an accumulator illustrated in FIG. 3.

Next, a description is given of the operations of the histogram memories 206*a* and 206*b*, and odd-numbered and even-numbered line accumulators 210*a* and 210*b* in more detail with reference to the timing diagram of FIG. 5.

The input image data ID illustrated in (a) of FIG. 5 is synchronized with the vertical synchronization signal (vertical reset signal) VD, the horizontal synchronization signal (horizontal reset signal) HD illustrated in (c) of FIG. 5, and the clock CLK illustrated in (b) of FIG. 5.

(d) of FIG. 5 illustrates the determination signal LINE outputted from the one-bit line counter 202 (FIG. 3). Herein, the determination signal LINE is 1 when the input image data ID is odd-numbered line image data ID(11) and is 0 when the input image data ID is even-numbered line image data ID(12).

As illustrated in (e) of FIG. 5, for example, the address counter 203 counts from 0 to 7 in increments of one in each period 1H and outputs the counter value AC. The address counter 203 repeatedly counts up in each period 1H. Herein, the number of pieces of image data (the number of horizontally arrayed pixels) in each period 1H is set to 8 for simple explanation.

During each odd-numbered line image data input period when the determination signal LINE is 1, the histogram memory 206*a* generates a histogram of an odd-numbered line.

During the above input period, the determination signal LINE of 1 is inputted to the write enable terminal WE of the histogram memory 206*a* as the write enable signal as illustrated in (h) of FIG. 5.

To the read address terminal RADRS of the histogram memory 206*a*, as schematically illustrated in (j) of FIG. 5, the odd-numbered line input image data ID(11) illustrated in (a) of FIG. 5 is inputted through the switch 209*a* that is connected to a terminal 1.

To the write address terminal WADRS of the histogram memory 206*a*, the pixel values of the input image data ID(11) as schematically illustrated in (i) of FIG. 5 are inputted as the write address. In the histogram memory 206*a*, data supplied to the terminal WDATA from the adder 208*a* (schematically illustrated in (m) of FIG. 5) is written using the pixel values of the input image data ID (11) as the write address.

The data read from the terminal RDATA of the histogram memory 206*a* represents the number of times that the write address inputted to the write address terminal WADRS is selected before the data is read as illustrated in (k) of FIG. 5.

The write data written in the histogram memory 206*a* is the value obtained by adding 1 through the adder 208*a* to data which is read from the terminal RDATA and represents the number of times that the write address is selected.

Specifically, in the input image data ID(11), eight pixels carry pixel values (gray levels) of 2, 5, 3, 2, 7, 2, 5, and 3 as illustrated in (a) of FIG. 5, for example. When these pixel values are inputted sequentially, the histogram memory 206*a* selects an address indicating each gray level as the read and write addresses.

In the histogram memory 206*a*, the value obtained by adding 1 to the number of times written in the selected read and write addresses is written.

To the clear terminal CLR of the histogram memory 206*a*, the horizontal synchronization signal HD is inputted from the AND circuit 207*a* as the clear signal.

The data values (histogram values) written in the addresses 0 to 7 in the histogram memory 206*a* are cleared to 0 by the clear signal at each rising edge of the horizontal synchronization signal HD as illustrated in (g) of FIG. 5.

The data values written in the addresses 0 to 7 in the histogram memory 206*a* are therefore 0 at first.

As illustrated in (k) of FIG. 5, the data values read from read addresses 2, 5, and 3 corresponding to the first three input pixel values are "0".

As illustrated in (m) of FIG. 5, the data values "0" in the addresses 2, 5, and 3 are added with "1", and the results of addition "1" are written to the addresses 2, 5, and 3 in the histogram memory 206*a*.

The data value read from the read address 2 corresponding to the subsequent fourth pixel value is "1" previously written and is then added with "1". The result of addition "2" is overwritten to the address 2.

After data of all the pixels of the line is inputted, therefore, the data value written to the address 2 is "3", the data values written to the addresses 3 and 5 are "2", the data value written to the address 7 is "1", and the data values written to the other addresses 0, 1, 4, and 6 are "0" as illustrated in (n) of FIG. 5.

The histogram memory 206*a* therefore stores histogram values HISTD_Q which are frequencies of respective gray levels of eight pixels of each odd-numbered line. In the histogram memory 206*a*, the addresses represent the gray levels, and the data values written to the addresses are frequencies of the respective gray levels.

The histogram memory 206*a* thus generates the histogram values HISTD_ODD of respective gray levels of the input image data of each odd-numbered line when the determination signal LINE is 1.

Subsequently, during each even-numbered line image data input period when the determination signal L is 0, by the same operation as that of the histogram memory 206*a* described above, the histogram memory 206*b* generates the histogram values HISTD_EVEN of respective gray levels of the input image data of an even-numbered line.

At the same time, since the histogram memory 206*a* is not supplied with the write enable signal of 1, the histogram memory 206*a* performs only reading operation and correct load variation using the histogram values HISTD_ODD stored in the previous odd-numbered line image data input period.

During each even-numbered line image data input period, the switch 209*a* is switched and connected to a terminal 0. Accordingly, the terminal RADRS of the histogram memory 206*a* is supplied with the counter value AC illustrated in (e) of FIG. 5 through the switch 209*a* as the read address as illustrated in (j) and (f) of FIG. 5.

The histogram memory 206*a* thereby uses the counter value AC, which counts in increments of 1, as the read address and the horizontal synchronization signal as the reset. As illustrated in (k) of FIG. 5, the histogram memory 206*a* sequentially outputs the histogram values HISTD_ODD stored during the odd-numbered line image data input period illustrated in (n) of FIG. 5.

The histogram values HISTD_ODD of the gray levels "2", "3", "5", and "7" read from the addresses 2, 3, 5, and 7 are 3, 2, 2, and 1, respectively. Moreover, the histogram values HISTD_ODD of the other gray levels "0", "1", "4", and "6" are 0.

The histogram values are delayed by one line. Accordingly, the image data of the odd-numbered line corresponding to the above period is delayed by one line and outputted from the data memory 205*a* as ID_ODD.

To the terminal INDATA of the odd-numbered line accumulator 210*a*, the histogram values HISTD_ODD of the gray levels of each odd-numbered line read from the histogram memory 206*a* (illustrated in (k) of FIG. 5) are inputted. The odd-numbered line accumulator 210*a* accumulates the histogram values HISTD_ODD and outputs cumulative sums HISTADD_ODD illustrated in (o) of FIG. 5 from a terminal EXDATA.

Each cumulative sum HISTADD_ODD is the number s of analog switches which are turned off at the current time.

The gray levels (data levels) of input image data ID(11) during the odd-numbered line image data input period, histogram values HISTD_ODD, and cumulative sums HISTADD_ODD which are described above are summarized as illustrated in FIG. 6.

During the image data input period of each even-numbered line, the same operation as that during each odd-numbered line image data input period is performed by the even-numbered line ramp signal data generator 201B. This operation is only shifted from the operation for the odd-numbered lines by the period 1H and can be easily known. The detailed description thereof is omitted.

The histogram memory 206*b* outputs the even-numbered line histogram values HISTD_EVEN, and the even-numbered line accumulator 210*b* outputs cumulative sums HISTADD_EVEN which indicate the number s of analog switches turned off at the process for each even-numbered line.

When the ramp signal is configured to change in level from the value corresponding to the lowest gray level to the value corresponding to the highest gray level value in each period 1H, the histogram memories 206*a* and 206*b* output histogram values in ascending order of gray levels in synchronization with the horizontal synchronization signal.

On the contrary, when the ramp signal has a waveform changing in level from the value corresponding to the highest gray level to the value corresponding to the lowest gray level value in the period 1H, the histogram memories 206*a* and 206*b* output histogram values in descending order of gray levels in synchronization with the horizontal synchronization signal.

In the following description, the ramp signal has the former waveform.

When the determination signal LINE supplied to a select terminal SEL is 0, the histogram value selector 212 illustrated in FIG. 3 selects the odd-numbered line cumulative sums HISTADD_ODD which are outputted from the odd-numbered line accumulator 210*a* and are supplied to a terminal A and outputs the same as the histogram value data HISTD as schematically illustrated in (p) of FIG. 5.

During this period, the image data selector 211 outputs image data ID_ODD of the same odd-numbered line as schematically illustrated in (q) of FIG. 5.

When the determination signal LINE supplied to the select terminal SEL is 1, the histogram value selector 212 selects the even-numbered line cumulative sums HISTADD_EVEN which are outputted from the even-numbered line accumulator 210*b* and are supplied to a terminal B and outputs the same as the histogram value data HISTD.

The ramp signal data generator 213 illustrated in FIG. 3 is supplied with the histogram value data HISTD selected and outputted from the histogram value selector 212, the clock CLK, and the horizontal synchronization signal HD.

The ramp signal data generator 213 generates ramp signal data VREFD of digital values. The ramp signal is a sawtooth wave changing in level from the value corresponding to the minimum gray level at the beginning of the period ID to the maximum gray level right before the end of the period 1H. Moreover, the ramp wave has a non-linear slope variably controlled in accordance with the cumulative sums.

The DA converter 214 includes a buffer and converts the ramp signal data VREFD (digital signal) to the ramp signal VREF (analog signal) based on the clock CLK. The DA converter 214 supplies the ramp signal VREF to the analog switches $\mathbf{107}_1$ to $\mathbf{107}_n$ through the ramp signal line Ls illustrated in FIG. 1A.

The ramp signal data generator 213 generates the digital ramp signal data VREFD having a non-linear slope variably controlled in accordance with the cumulative sums. The conversion analog signal generator 101 thereby reduces voltage fluctuation of the ramp signal due to load variation dynamically caused by the output impedance of the DA converter 214 and the input impedance represented by the analog switches $\mathbf{107}_1$ to $\mathbf{107}_n$.

Figure 16:
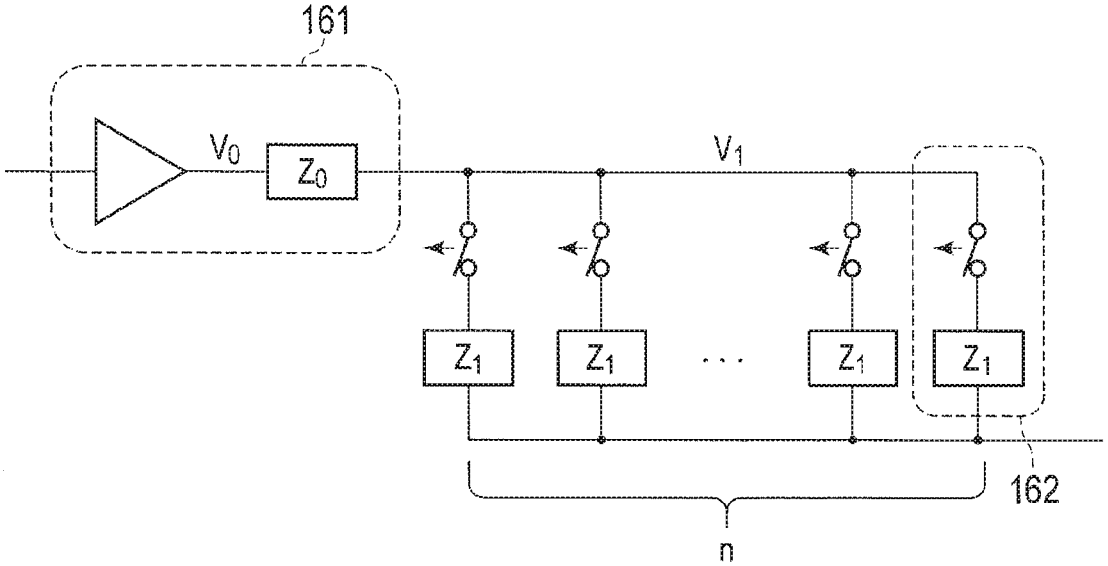
FIG. 16 is a diagram illustrating an example of the equivalent circuit of an output section of the conversion analog signal generator and an analog switch.
Figure 17:
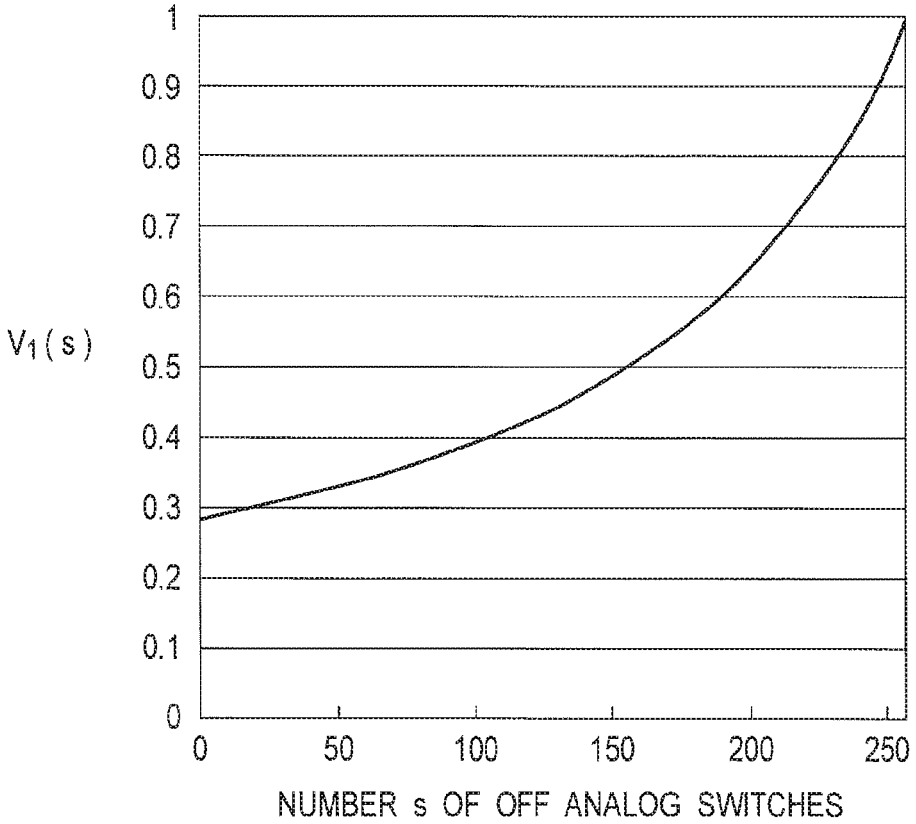
FIG. 17 is a diagram illustrating an example of the relationship between the number of off analog switches and input voltage of analog switches in the conventional image display apparatus.

The reduction of the changes in voltage of the ramp signal is concretely described below. The equivalent circuit of the circuit section including the DA converter 214 and analog switches $\mathbf{107}_1$ to $\mathbf{107}_n$ is illustrated in FIG. 16 in a similar manner to the conventional one. Herein, the load variation rate is expressed by the following equation:

$$\text{Load variation rate}=V_1(s)/V_0=Z_1/\{(n-s)Z_0+Z_1\} \quad (2)$$

where $Z_1$ is the input impedance of each analog switch $\mathbf{107}_1$ to $\mathbf{107}_n$ illustrated in FIG. 1A and s is the number of analog switches which are turned off to display the input gray level.

In Equation (2), $0<=s<=n$, and $V_0$ is output voltage of the buffer of the DA converter 214. $V_1(s)$ is ramp signal voltage supplied from the DA converter 214 through the ramp signal line Ls to the n analog switches.

Figure 7:
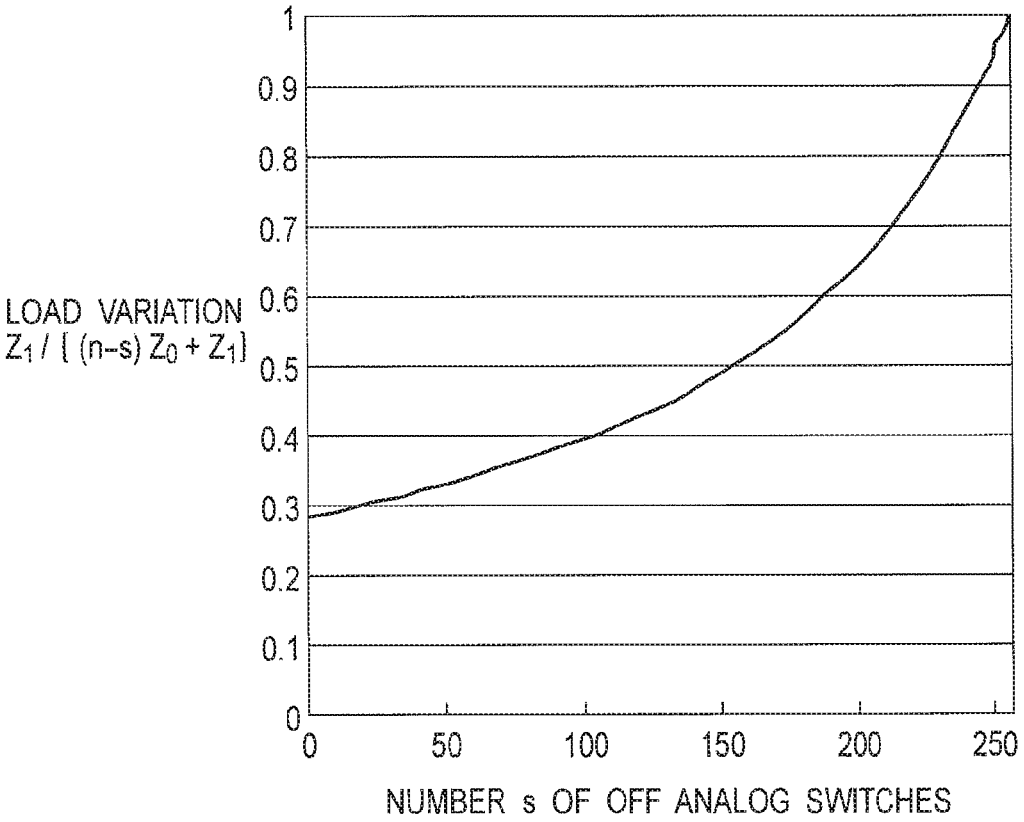
FIG. 7 is a diagram illustrating an example of the relationship between load variation rate and the number of off analog switches.

FIG. 7 illustrates a graph of an example of the relationship between load variation rate and the number s of off analog switches. The load variation rate expressed by Equation (2) changes non-linearly to the number s of off analog switches as illustrated in FIG. 7 where $Z_0=1$, $Z_1=100$, and the total number n of analog switches=256.

The smaller the number s of off analog switches, the lower the load variation rate. The aforementioned parameters are set for easy visual understanding and may be different from the actual parameters.

The load variation rate illustrated in FIG. 7 changes non-linearly to the number s of off analog switches.

The ramp signal data generator 213 in the image display apparatus 100 generates the ramp signal data VREFD by multiplying the ramp signal by load variation correction data corresponding to the load variation rate (illustrated in FIG. 8) depending on the number s of off analog switches. The number s is the cumulative sum (the histogram value) of the number of target pixels carrying each gray level and is obtained from the histogram memories 206*a* and 206*b*.

The ramp signal data VREFD is digital data, and when the ramp signal data VREFD is converted into the ramp signal VREF having an analog waveform, the ramp signal VREF is variably controlled in accordance with the histogram values and has a non-linear slope.

Figure 8:
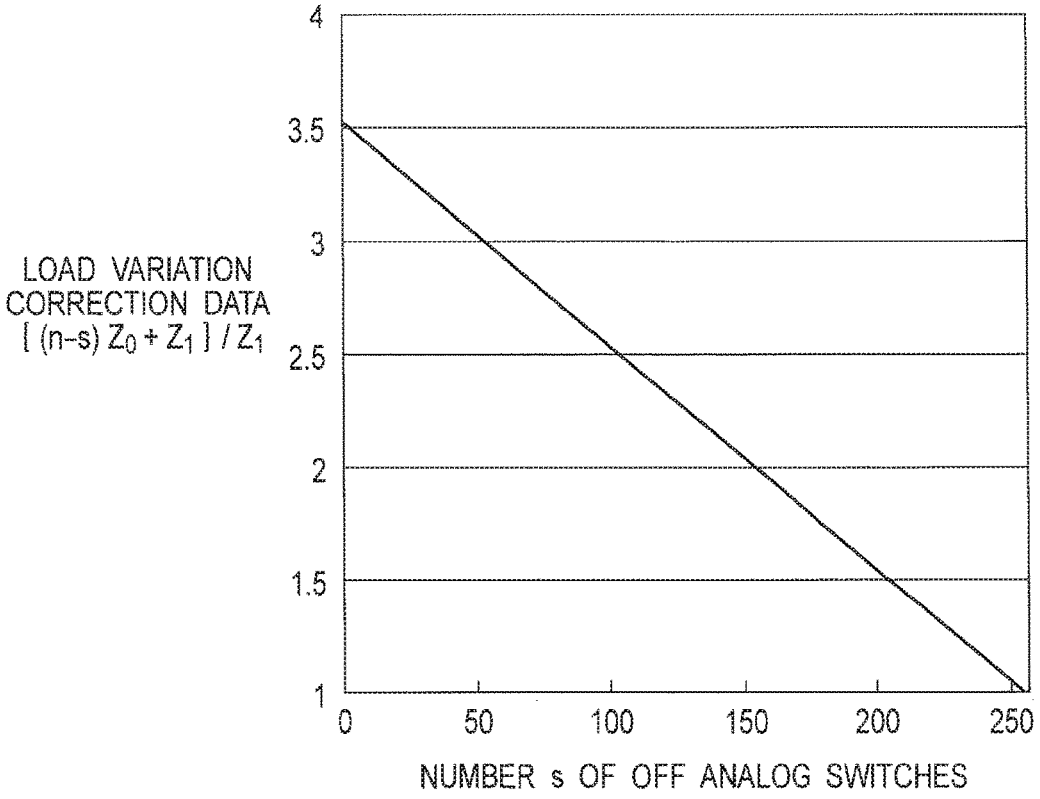
FIG. 8 is a diagram illustrating an example of the relationship between load variation correction data and the number of off analog switches.

The load variation correction data illustrated in FIG. 8 is calculated by Equation (3), for example.

$$\text{Load Variation Correction Data}=\{(n-s)Z_0+Z_1\}/Z_1 \quad (3)$$

The load variation correction data is the reciprocal of the load variation rate expressed by Equation (2). The load variation correction data only needs to include data values allowing correction based on the load variation and is not limited to Equation (3).

In accordance with the image display apparatus 100 according to the embodiment, the aforementioned operation reduces grayscale degradation due to voltage fluctuation of the ramp signal VREF which is caused by load variation of the ramp signal data generator 213 that dynamically changes depending on the number of pixels carrying each gray level in each line of the display digital video signal.

Next, a description is given of the operation to generate the ramp signal data VREFD with the load variation of the ramp signal data generator 213 corrected more specifically in more detail with reference to FIGS. 9, 10A, 10B, 11A, and 11B.

Figure 9:
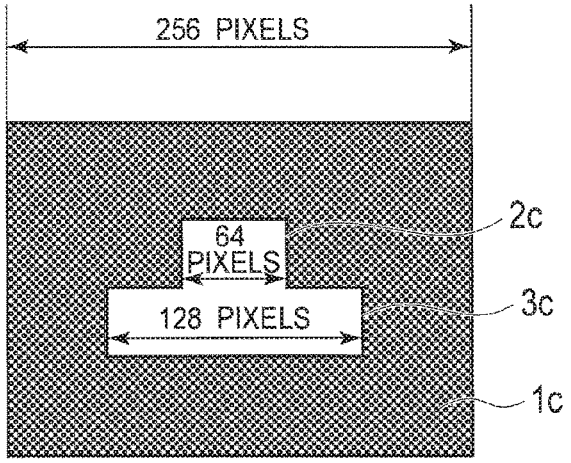
FIG. 9 is a diagram illustrating an example of display images of the image display apparatus according to the embodiment.

As illustrated in FIG. 9, it is assumed that the image display apparatus 100 displays an image including a 50% gray box (an image 2*c*) and a 50% gray box (an image 3*c*) which are arranged side by side in vertical direction on an image 1*c* which is a black background. The box of the image 2*c* includes 64 pixels in the horizontal direction. The box of the image 3*c* includes 128 pixels in the horizontal direction. The total number n of pixels in the horizontal direction is 256.

Figure 15A:
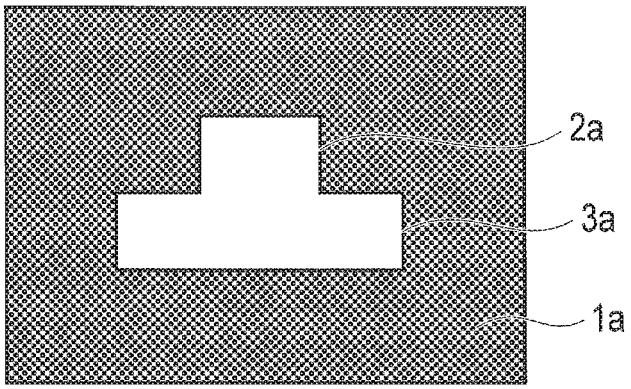
FIG. 15A is a diagram illustrating an example of an original image to be displayed on a conventional image display apparatus.

In FIG. 9, the 50% gray images 2*a* and 3*a* are illustrated in white. The image illustrated in FIG. 9 is the same image as the original image illustrated in FIG. 15A.

Figure 10A:
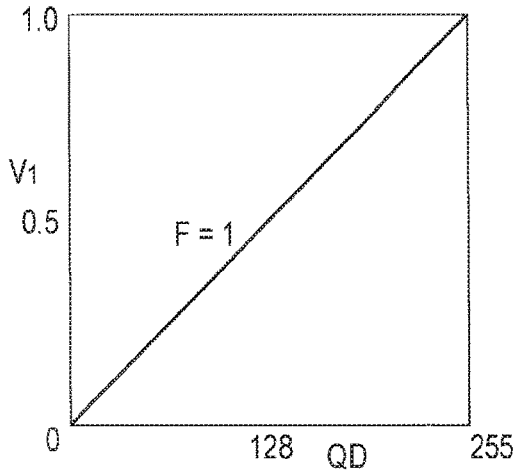
FIG. 10A is a diagram illustrating the load variation rate of image 1C of the display image illustrated in FIG. 9.
Figure 10B:
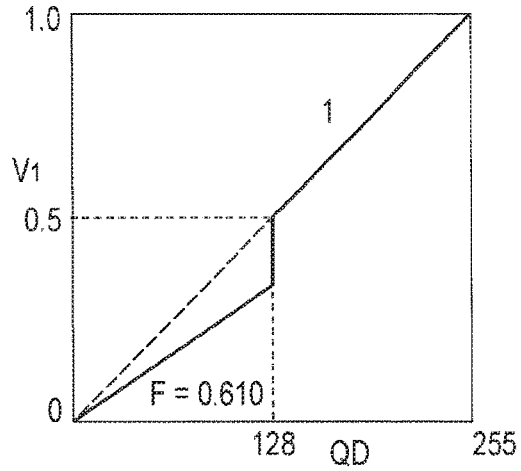
FIG. 10B is a diagram illustrating the load variation rate of image 2C of the display image illustrated in FIG. 9.
Figure 10C:
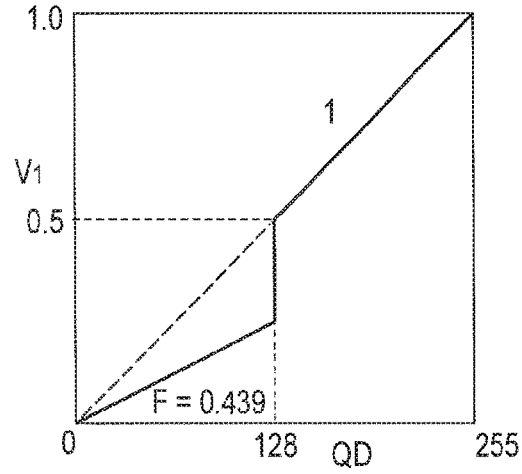
FIG. 10C is a diagram illustrating the load variation rate of image 3C of the display image illustrated in FIG. 9.
Figure 11A:
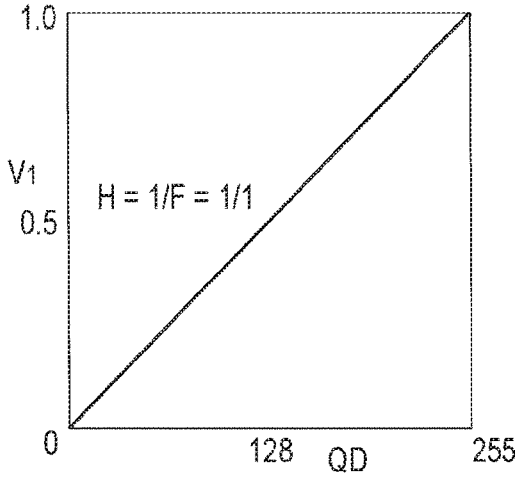
FIG. 11A is a diagram illustrating ramp signal data in displaying image 1C of the display image illustrated in FIG. 9.
Figure 11B:
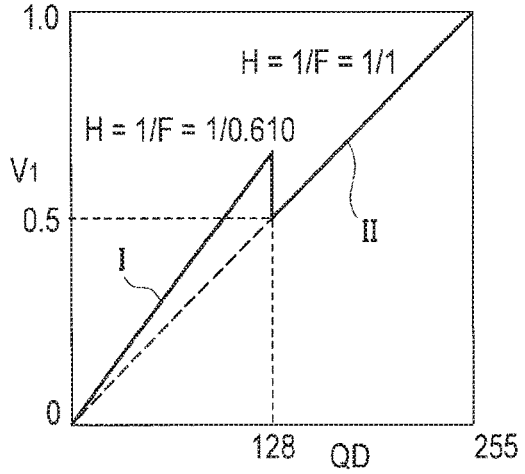
FIG. 11B is a diagram illustrating ramp signal data in displaying image 2C of the display image illustrated in FIG. 9.
Figure 11C:
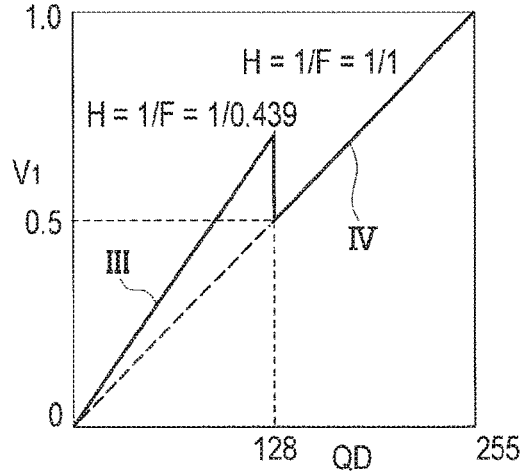
FIG. 11C is a diagram illustrating ramp signal data in displaying image 3C of the display image illustrated in FIG. 9.

FIGS. 10A, 10B, and 10C illustrate the load variation rate F at displaying the images 1*c*, 2*c*, and 3*c* by the relationship between the counter value QD and input voltage $V_1$, respectively. FIGS. 11A, 11B, and 11C illustrate the slope of the ramp signal data VREFD at displaying the images 1*c*, 2*c*, and 3*c* by the relationship between the counter value QD and input voltage $V_1$.

The counter value QD represented by the horizontal axes in FIGS. 10A to 10C and 11A to 11C is outputted from the gray-level counter 105 of FIG. 1A and is increased from 0 to 255 corresponding to the number of pixels horizontally arranged (256 pixels) in increments of one in the period 1H in synchronization with the clock period.

In the case of not performing load variation correction, the ramp signal data generator 213 generates a ramp signal having a triangle waveform with the 1H period. The ramp signal linearly changes with time from 0 V representing the black level as the minimum gray level (corresponding to 0% light transmittance of the liquid crystal layer) to 1 V representing the white level as the maximum gray level (corresponding to 100% light transmittance of the liquid crystal layer) in the period 1H, and the waveform thereof has a linear slope.

In Equations (2) and (3), $Z_0=1$, and $Z_1=100$.

In the process of displaying any one line of the image 1*c* as the black background, all of the 256 pixels horizontally arranged have a gray level of 0, and all of the 256 analog switches corresponding to all the pixels horizontally arranged are simultaneously turned off when the counter value QD is 0.

The 256 analog switches then remain turned off during the period 1H in which the counter value QD changes to 255. The load variation rate F(255) in this process is 1 as illustrated in FIG. 10A (no load variation).

Herein, the load variation rate F(255) is expressed by $100/\{256-256\}\times1+100\}$. In the process of displaying any one line of the image 1C, there is no load variation, and the ramp signal data generator 213 generates the ramp signal data VREFD of a triangular waveform with the level linearly changing from 0 V to 1 V as the counter value QD changes as illustrated in FIG. 11A.

Next, in the process of displaying a line of the 50% gray image 2*c* having a shorter horizontal width, among 256 pixels in the line, 64 pixels are 50% gray, and the remaining 192 pixels are of the same gray level as the black background.

Accordingly, when the counter value QD is 0 just after the beginning of the horizontal scanning period, the 192 analog switches corresponding to the 192 pixels of the same gray level as the black background are simultaneously turned off, and the 64 analog switches corresponding to the 64 pixels remain turned on.

When the counter value QD becomes 128 indicating the gray level of 50%, the counter value QD matches pixel values of 50%. Upon the matching pulses outputted from the comparators $\mathbf{106}_1$ to $\mathbf{106}_n$, the remaining 64 analog switches are turned off, and 0.5 V of the ramp signal (the triangular waveform), that indicates the gray level of 50%, is sampled just before the analog switches are turned off. All the 256 analog switches are turned off at this time.

Accordingly, in the process of displaying the image 2*c*, as illustrated in FIG. 10B, the load variation rate F(192) is 0.610 ($=100/\{256-192\}\times1+100$) by Equation (2) in the period when the counter value QD is 0 to 127 and is 1 when the counter value QD is 128 to 255.

In FIG. 10B, the load variation rate F shows a non-linear line which has a slope of 0.610 in a range of the counter value QD from 0 to 127 and has a slope of 1 in a range of the counter value QD from 128 to 255.

Accordingly, the ramp signal data generator 213 generates a load variation correction value H for correcting the load variation rate F(192) using Equation (3) and generates the ramp signal data VREFD having a slope changing as indicated by I in FIG. 11B in accordance with the counter value QD.

When the counter value QD is from 128 to 255, the load variation rate F(255) is 1. Accordingly, the slope of the ramp signal data VREFD is 1 as indicated by II in FIG. 11B.

The ramp signal data generator 213 thus generates the ramp signal data VREFD having a non-liner slope illustrated in FIG. 11B.

Next, in the process of displaying each line of the 50% gray image 3*c* having a larger horizontal width, among 256 pixels in the line, 128 pixels are 50% gray, and the remaining 128 pixels are of the same gray level as the black background.

Accordingly, when the counter value QD is 0 just after the beginning of the horizontal scanning period, the 128 analog switches corresponding to the 128 pixels of the same gray level as the black background are simultaneously turned off, and the 128 analog switches corresponding to the other 128 pixels remain turned on.

When the counter value QD becomes 128 corresponding to a gray level of 50%, the counter value QD matches pixel values of 50%. Upon the matching pulses outputted from the comparators 106$_1$ to 106$_n$, the remaining 128 analog switches are turned off, and 0.5 V of the ramp signal (the triangular waveform) that indicates a gray level of 50%, is sampled just before the analog switches are turned off. All the 256 analog switches are turned off at this time.

Accordingly, in the process of displaying the image 3*c*, as illustrated in FIG. 10C, the load variation rate F(128) is 0.439 (=100/{256−128}×1+100) by Equation (2) in the period when the counter value QD is 0 to 127 and is 1 when the counter value QD is 128 to 255.

In FIG. 10C, the load variation rate F shows a non-linear line having a slope of 0.439 in a range of the counter value QD i from 0 to 127 and has a slope of 1 in a range of the counter value QD from 128 to 255.

Accordingly, the ramp signal data generator 213 generates the load variation correction value H for correcting the load variation rate F(192) using Equation (3) and generates the ramp signal data VREFD having a slope changing as indicated by III in FIG. 11C as the counter value QD changes.

When the counter value QD is from 128 to 255, the load variation rate F(255) is 1. Accordingly, the ramp signal data VREFD has a slope of 1 as indicated by IV in FIG. 11C.

The ramp signal data generator 213 thus generates the ramp signal data VREFD having a non-liner slope illustrated in FIG. 11C. The slope in the part indicated by I in FIG. 11B is different from that of the slope in the part indicated by III of FIG. 11C.

Figure 15B:
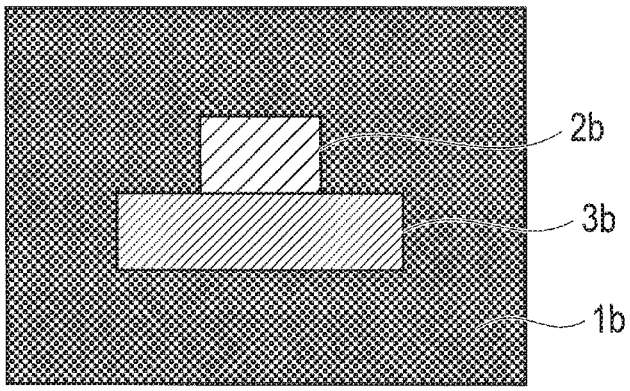
FIG. 15B is a diagram illustrating a display image displayed on the conventional image display apparatus based on the original image illustrated in FIG. 15A.

In the embodiment, the ramp signal is generated based on the ramp signal data VREFD by correcting the load variation. Accordingly, compared with the conventional images 2*b* and 3*b* in the display image of FIG. 15B, the displayed images of the images 2*c* and 3*c* obtained by sampling and holding the ramp signal VREF include less degradation in tonality and can be displayed in nearly original 50% gray.

Next, a description is given of specific configuration examples of the ramp signal data generator 213 illustrated in FIG. 3.

(First Configuration Example of Ramp Signal Generating Section)

Figure 12:
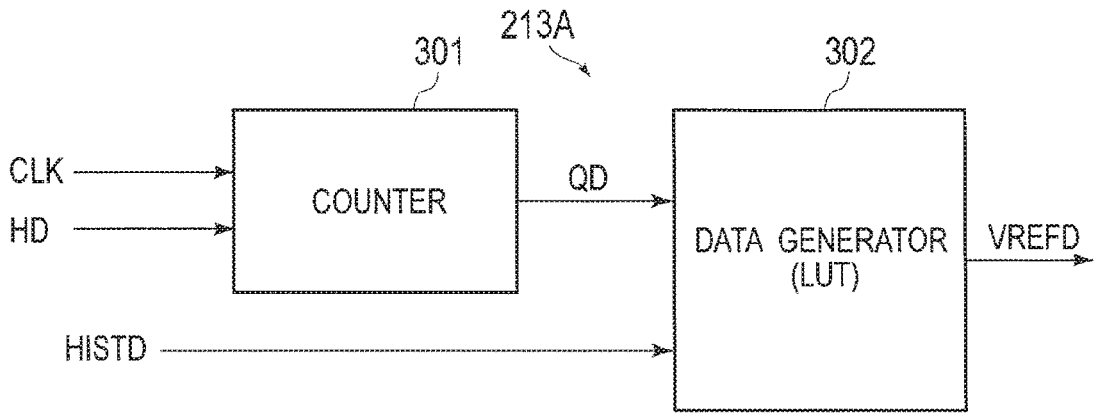
FIG. 12 is a block diagram illustrating the first configuration example of the ramp signal data generator illustrated in FIG. 3.

FIG. 12 is a block diagram of a first configuration example of the ramp signal data generator 213. A ramp signal data generator 213A of the first configuration example illustrated in FIG. 12 includes a counter 301 and a data generator 302. The counter 301 counts up or down the pulses of the clock CLK. The counter 301 is reset by the horizontal synchronization signal HD to generate counter values representing the minimum through maximum gray levels in each horizontal scanning period.

The clock CLK is the clock illustrated in (e) of FIG. 2 and (f) of FIG. 4. The counter 301 outputs a counter value QD (a second counter value) synchronized with the counter value QD (a first counter value) outputted from the gray-level counter 105 illustrated in FIG. 1A.

The data generator 302 receives the histogram value data HISTD outputted from the histogram value selector 212 illustrated in FIG. 3 and the counter value QD of the counter 301 as an address. The data generator 302 outputs the ramp signal data VREFD as digital signal corresponding to the histogram value data HISTD and counter value QD.

The data generator 302 can be composed of a look-up table (LUT). The histogram value data HISTD inputted as an address represents the number s of off analog switches for each value of the counter value QD. The data generator 302 can therefore generate the ramp signal data VREFD of a triangle wave having slope characteristics with the load variation corrected.

The data generator 302 stores ramp signal data (LUT data) including at least one of the following features: correction of the triangle waveform represented by the counter value QD; execution of de-gamma for display digital video signal; and to correction of the voltage-transmittance characteristics (VT characteristics) of liquid crystal elements.

The data generator 302 supplies the generated ramp signal data VREFD to the DA converter 214 illustrated in FIG. 3.

When the load variation rate illustrated in FIG. 7 has a non-linear characteristic in particular and the load variation rate steeply rises, tonal steps are seen on the display image. The ramp signal data generator 213A of the first configuration example is suitably used when the tonal steps seen in the image are too noticeable to be acceptable.

The ramp signal data generator 213A of the first configuration example is optimal for the case where the ramp signal needs to have non-linearity for degamma of the display digital video signal among monotonically increasing functions instead of using the gray level data constituting a simple triangle wave and the case where the VT characteristics of liquid crystal elements need to be corrected all at once.

Even when the analog switches 107$_1$ to 107$_n$ vary in impedance and serve as a buffer load non-linear to the histogram values, the ramp signal data generator 213A of the first configuration example is adaptable to various cases by designing the LUT data to fit to the load characteristics of the analog switches 107$_1$ to 107$_n$.

The ramp signal data generator 213A can effectively prevent tonality degradation.

(Second Configuration Example of Ramp Signal Generating Section)

Figure 13:
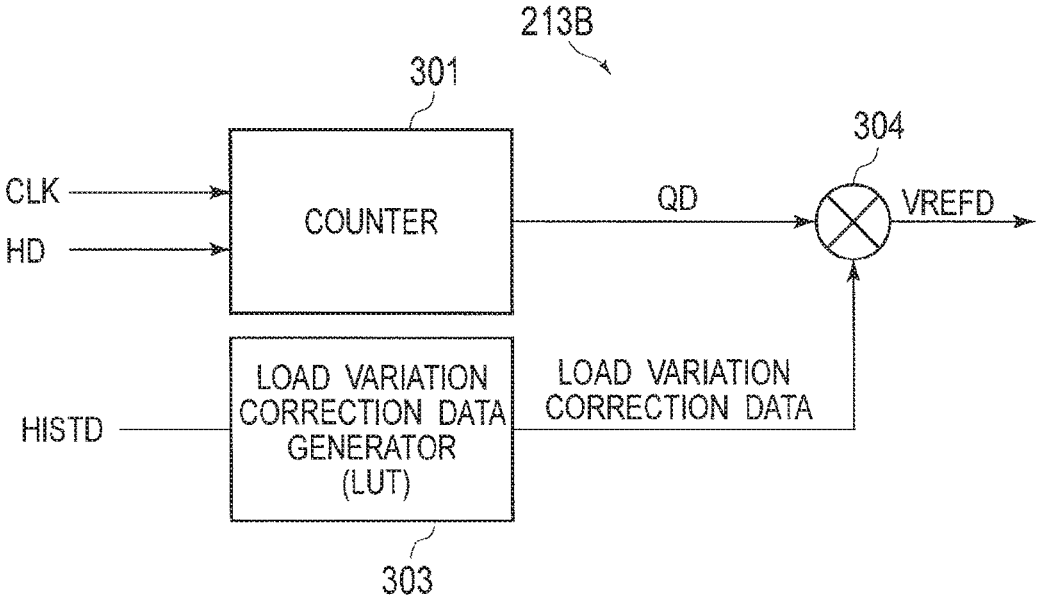
FIG. 13 is a block diagram illustrating the second configuration example of the ramp signal data generator illustrated in FIG. 3.

FIG. 13 illustrates a block diagram of a second configuration example of the ramp signal data generator 213. In FIG. 13, the same constituent portions as those of FIG. 12 are given the same reference numerals. A ramp signal data generator 213B of the second configuration example illustrated in FIG. 13 includes a multiplier instead of the data generator 302 in FIG. 12 and further includes a load variation correction data generator 303.

The load variation correction data generator 303 is composed of an LUT, for example. The load variation correction data generator 303 receives the histogram value data HISTD as an address. The load variation correction data generator 303 generates the load variation correction data having the characteristics illustrated in FIG. 8 and supplies the generated data to the multiplier 304.

The LUT constituting the load variation correction data generator 303 outputs the load variation correction data having data values corresponding to the number s of off analog switches indicated by the histogram value data HISTD inputted as the address.

The multiplier 304 multiplies the counter value QD from the counter 301 (the multiplied value) by the load variation correction data (the multiplying value) and supplies the result of multiplication to the DA converter 214 (FIG. 3) as the ramp signal data VREFD.

The ramp signal data VREFD represents a digital ramp signal of a sawtooth wave changing in level from a value corresponding to the minimum gray level at the beginning of each period 1H and having a value corresponding to the maximum gray level just before the end of the period 1H and has a non-linear slope variably controlled in accordance with the histogram value data HISTD.

The ramp signal data generator 213B of the second configuration example is effective when the number n of pixels horizontally arranged is not large and when the output impedance $Z_0$ of the buffer within the DA converter 214 is small enough compared with the input impedance $Z_1$ of the analog switches $\mathbf{107}_k$ to $\mathbf{107}_n$ ($Z_0 \ll Z_1$).

Moreover, since the ramp signal data generator 213B generates the ramp signal data VREFD using the multiplier 304 instead of the LUT, the ramp signal data generator 213B has a simple configuration and can provide the effect of reducing the load variation at a low cost.

(Third Configuration Example of Ramp Signal Generating Section)

Figure 14:
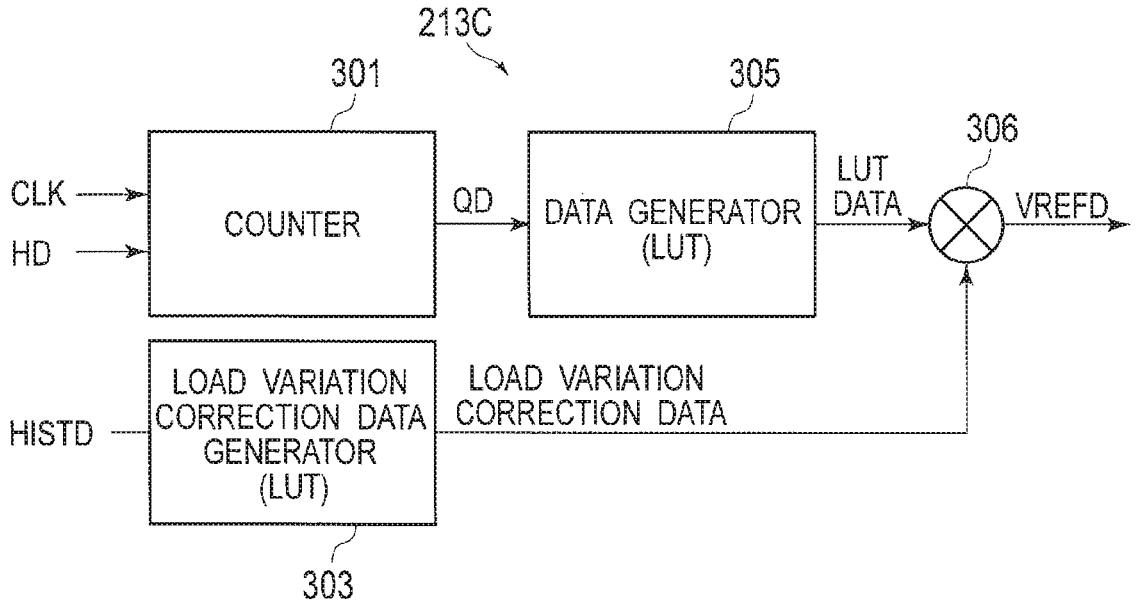
FIG. 14 is a block diagram illustrating the third configuration example of the ramp signal data generator illustrated in FIG. 3.

FIG. 14 illustrates a block diagram of a third configuration example of the ramp signal data generator 213. In FIG. 14, the same constituent portions as those of FIG. 13 are given the same reference numerals.

A ramp signal data generator 213C illustrated in FIG. 14 is composed of a combination of the ramp signal data generators 213A and 213B. The ramp signal data generator 213C multiplies the LUT data outputted from the data generator 305 by the load variation correction data outputted from the load variation correction data generator 303, through the multiplier 306.

The data generator 305 is composed of an LUT. The data generator 305 receives the counter value QD from the counter 301 as an address. The data generator 305 stores LUT data (correction data) for performing degamma processing for display digital video signal or correcting the VT characteristics of liquid crystal elements.

The multiplier 306 multiplies the LUT data from the data generator 305 (multiplied value) by the load variation correction data (multiplying value) and supplies the result of multiplication to the DA converter 214 (FIG. 3) as the ramp signal data VREFD.

The ramp signal data generator 213C is effective for the case of correcting the VT characteristic of liquid crystal elements, the case of performing degamma, and the case where the load variation is considered to be substantially linear to the number s of off analog switches.

The correction of the VT characteristic of liquid crystal elements and correction by degamma processing are generally non-linear to the grayscale. The ramp signal data generator 213C is effective in the case of requiring correction parameters and the case of properly changing the correction value (the degamma characteristic) for cancelling the signal gamma value that varies on video contents, such as 2.2, 1.8, and 2.6. An example of the correction parameters is a correction parameter concerning variation in liquid crystal film thickness in the manufacturing process. The liquid crystal film thickness varies between display elements.

The ramp signal data generator 213C performs the aforementioned correction in the data generator 305 and multiplies the LUT data outputted from the data generator 305 by the load variation correction data through the subsequent multiplier 306, thereby reducing the load variation.

According to the aforementioned configuration of the ramp signal data generator 213C, the memory size for the LUT can be significantly reduced, thereby reducing the cost and size of the image display apparatus.

According to the image display apparatus 100 of the embodiment described above, in an image display apparatus using a ramp signal for DA conversion, it is possible to precisely reduce the tonality degradation (waveform interference) due to voltage fluctuation in the ramp signal VREF which is caused by the load variation of the ramp signal data generator 213 dynamically changing in each line of the digital video signal for the display.

According to the image display apparatus 100 of the embodiment, by controlling the effect of reducing the tonality degradation in accordance with variation in analog switch characteristics of display elements, it is possible to implement high quality display excellent in tonality.

According to the image display apparatus 100 of the embodiment, it is not necessary to provide dummy pixels in the pixels. It is therefore possible to avoid yield reduction due to an increase in circuit scale and suppress an increase in cost.

The present invention is not limited to the above-described embodiment and can be modified in various ways. For example, the ramp signal may be composed of a sawtooth wave changing in level from the value corresponding to the maximum gray level to the value corresponding to the minimum gray level in each horizontal scanning period.

In this case, the counter value needs to be counted down from the value corresponding to the maximum gray level to the value corresponding to the minimum gray level.

As described above, according to the image display apparatus of the embodiment, it is possible to prevent tonality degradation (waveform interference) without providing dummy pixels and implement high-quality display with excellent tonality.

The present invention is applicable to an image display apparatus using other display elements similar to the liquid crystal display elements. The present invention is applicable to every image display apparatus that performs image display using DA conversion.

What is claimed is:

1. An image display apparatus, comprising:

a pixel section including a plurality of pixels arranged at intersections of a plurality of data lines and a plurality of gate lines;

a vertical direction driver configured to sequentially supply a pixel selection signal to the plurality of gate lines and sequentially select each pixel of the pixel section on the basis of pixels of each line;

a plurality of analog switches connected to the plurality of data lines one to one;

a holding section configured to hold image data of pixels of a line of a display digital video signal;

a conversion analog signal generator configured to generate a ramp signal composed of a sawtooth wave, to commonly supply the generated ramp signal to the plurality of analog switches, and to supply image data of the pixels of the line to the holding section in synchronization with the ramp signal, the ramp signal changing in level with time at such a slope that the level of the ramp signal starts with one of black and white levels at the beginning of each horizontal scanning period and reaches the other level right before the end of the horizontal scanning period and the slope is variably-controlled in accordance with the number of analog switches turned off among the plurality of analog switches to be non-linear; and a controller configured to simultaneously turn the plurality of analog switches on at the beginning of each horizontal scanning period to supply the ramp signal to the plurality of data lines through the plurality of analog switches, to compare on a pixel-by-pixel basis, the image data of the pixels of the line held by the holding section with a first counter value sequentially changing from one of minimum and maximum gray levels to the other in each horizontal scanning period, to turn off only the analog switches provided corresponding to the pixels having pixel data matching the first counter value until the beginning of the next horizontal scanning period, and through the data lines connected to the analog switches turned off, to cause the pixels to sample and hold the potential of the ramp signal just before the analog switches are turned off, wherein the conversion analog signal generator comprises:

a histogram value output section configured to detect histogram values of respective gray levels included by image data of the pixels of the line and outputs histogram value data at each horizontal scanning period;

an accumulator configured to accumulate the histogram value data to calculate a cumulative sum representing the number of analog switches turned off among the plurality of analog switches;

a ramp signal data generator configured to generate ramp signal data having a non-linear slope variably-controlled in accordance with the cumulative sum so as to reduce voltage fluctuation of the ramp signal due to load variation caused and depending on the number of analog switches turned off;

a DA converter configured to convert the ramp signal data to the ramp signal as an analog signal and supply the ramp signal to the plurality of analog switches; and a delay section configured to delay the image data of the pixels of the one line and supply the delayed image data to the holding section in synchronization with the ramp signal outputted from the DA converter.

2. The image display apparatus according claim 1, wherein the ramp signal data generator comprises:

a counter configured to be reset by the horizontal scanning signal of the display digital video signal, count pulses of a clock with a predetermined frequency, and generate a second counter value synchronized with the first counter value; and a data generator configured to receive the second counter value generated by the counter and the cumulative sum calculated by the accumulator as an address and output the ramp signal data.

3. The image display apparatus according claim 2, wherein the ramp signal data outputted by the data generator is ramp signal data having a non-linear slope characteristic enabling degamma for the display digital video signal.

4. The image display apparatus according claim 1, wherein the ramp signal data generator comprises:

a counter configured to be reset by the horizontal scanning signal of the display digital video signal, count pulses of a clock with a predetermined frequency, and generate a second counter value synchronized with the first counter value;

a load variation correction data generator configured to generate load variation correction data to correct the load variation expressed by $Z_1/\{(n-s)Z_0+Z_1\}$ where n is the total number of the plurality of analog switches, s is the number of analog switches turned of at a predetermined timing among the plurality of analog switches ($0<=s<=n$), $Z_0$ is output impedance of a buffer of the DA converter, and $Z_1$ is input impedance of each of the plurality of analog switches; and a multiplier configured to multiply the second counter value generated by the counter by the load variation correction data generated by the load variation correction data generator and outputs the result of multiplication as the ramp signal data.

5. The image display apparatus according claim 1, wherein the ramp signal data generator comprises:

a counter configured to be reset by the horizontal scanning signal of the display digital video signal, count pulses of a clock with a predetermined frequency, and generate a second counter value synchronized with the first counter value;

a load variation correction data generator configured to generate load variation correction data to correct the load variation rate expressed by $Z_1/\{(n-s)Z_0+Z_1\}$ where n is the total number of the plurality of analog switches, s is the number of analog switches turned of at a predetermined timing among the plurality of analog switches ($0<=s<=n$), $Z_0$ is output impedance of a buffer of the DA converter, and $Z_1$ is input impedance of each of the plurality of analog switches;

a data generator configured to receive the second counter value generated by the counter as an address and generate in accordance with the address, correction data for executing degamma for the display digital video signal or correcting the voltage-transmittance characteristic of liquid crystal elements included by the pixels; and a multiplier configured to multiply the correction data generated by the data generator by the load variation correction data and outputs the result of multiplication as the ramp signal data.

* * * * *